US008471468B2

(12) United States Patent
Kim et al.

(10) Patent No.: US 8,471,468 B2
(45) Date of Patent: Jun. 25, 2013

(54) PLASMA DISPLAY PANEL AND MULTI PLASMA DISPLAY PANEL

(75) Inventors: Kyungtae Kim, Gumi (KR); Seungmun Shin, Gumi (KR); Youngjoon Ahn, Gumi (KR)

(73) Assignee: LG Electronics Inc., Seoul (KR)

( * ) Notice: Subject to any disclaimer, the term of this patent is extended or adjusted under 35 U.S.C. 154(b) by 192 days.

(21) Appl. No.: 12/985,516

(22) Filed: Jan. 6, 2011

(65) Prior Publication Data

US 2011/0169716 A1 Jul. 14, 2011

(30) Foreign Application Priority Data

Jan. 11, 2010 (KR) ..... 10-2010-0002312
Jan. 15, 2010 (KR) ..... 10-2010-0003902

(51) Int. Cl.
*G09G 3/28* (2006.01)
*G09G 5/00* (2006.01)

(52) U.S. Cl.
USPC ..... 313/582; 313/581; 313/587; 445/24

(58) Field of Classification Search
CPC ... H01L 27/156; H01L 27/3293; G02F 1/1309; G02F 2201/42
USPC ..... 313/581–587; 345/1.1, 1.3
See application file for complete search history.

(56) References Cited

U.S. PATENT DOCUMENTS

| | | | | |
|---|---|---|---|---|
| 2005/0017637 | A1* | 1/2005 | Kang et al. | 313/582 |
| 2006/0290596 | A1 | 12/2006 | Kweon et al. | 345/60 |
| 2008/0122359 | A1 | 5/2008 | Song | 313/584 |
| 2008/0174245 | A1* | 7/2008 | Soh et al. | 313/582 |
| 2011/0115357 | A1* | 5/2011 | Lee et al. | 313/1 |
| 2011/0115364 | A1* | 5/2011 | Kim | 313/317 |
| 2011/0128208 | A1* | 6/2011 | Choi | 345/1.1 |
| 2011/0259624 | A1* | 10/2011 | Lee et al. | 174/50.5 |

FOREIGN PATENT DOCUMENTS

| | | | |
|---|---|---|---|
| EP | 2 323 157 | A2 | 5/2011 |
| KR | 10-2005-0029565 | A | 3/2005 |

OTHER PUBLICATIONS

Chang, Korean Patent Application Publication 2005-0029565, May 2008, machine translation.*
European Search Report dated Nov. 3, 2011 issued in Application No. 11 00 0160.

* cited by examiner

*Primary Examiner* — Tracie Y Green
(74) *Attorney, Agent, or Firm* — KED & Associates LLP

(57) ABSTRACT

A plasma display panel and a multi plasma display panel are disclosed. The multi plasma display panel includes a plurality of plasma display panels that are positioned adjacent to one another. Each of the plurality of plasma display panels includes a front substrate, a back substrate positioned opposite the front substrate, and a plurality of barrier ribs positioned between the front substrate and the back substrate. The plurality of barrier ribs partition a plurality of discharge cells. A size of a discharge cell in a boundary portion between two plasma display panels of the plurality of plasma display panels is greater than a size of a discharge cell in other portions.

8 Claims, 39 Drawing Sheets

PLASMA DISPLAY PANEL AND MULTI PLASMA DISPLAY PANEL

This application claims the benefit of Korean Patent Application Nos. 10-2010-0002312 filed on Jan. 11, 2010 and 10-2010-0003902 filed on Jan. 15, 2010, which are incorporated herein by reference for all purposes as if fully set forth herein.

BACKGROUND OF THE INVENTION

1. Field of the Invention

Embodiments of the invention relate to a plasma display panel and a multi plasma display panel.

2. Description of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display panel comprising a front substrate, a back substrate positioned opposite the front substrate, and a plurality of barrier ribs positioned between the front substrate and the back substrate, the plurality of barrier ribs configured to partition a plurality of discharge cells, wherein first and second discharge cells are positioned in an active area of the plasma display panel, and a size of the first discharge cell is less than a size of the second discharge cell closer to an edge region of the plasma display panel than the first discharge cell.

In another aspect, there is a plasma display panel comprising a front substrate on which a plurality of front electrodes are disposed, a back substrate on which a plurality of address electrodes are disposed to cross the plurality of front electrodes, and a plurality of barrier ribs positioned between the front substrate and the back substrate, the plurality of barrier ribs configured to partition a plurality of discharge cells, wherein a width of the address electrode in a first region of the plasma display panel is less than a width of the address electrode in a second region positioned outside the first region.

In yet another aspect, there is a plasma display panel comprising a front substrate on which a plurality of front electrodes are disposed, a back substrate on which a plurality of address electrodes are disposed to cross the plurality of front electrodes, and a plurality of barrier ribs positioned between the front substrate and the back substrate, the plurality of barrier ribs configured to partition a plurality of discharge cells, wherein a width of the address electrode measured in a direction parallel to the address electrodes in an edge region of the plasma display panel is greater than a width of the address electrode measured in the direction parallel to the address electrodes in a middle region of the plasma display panel, wherein a width of the address electrode measured in a direction crossing the address electrodes in the edge region of the plasma display panel is greater than a width of the address electrode measured in the direction crossing the address electrodes in the middle region of the plasma display panel.

In yet another aspect, there is a multi plasma display panel comprising a first plasma display panel, a second plasma display panel positioned adjacent to the first plasma display panel, a third plasma display panel positioned adjacent to the first plasma display panel, and a fourth plasma display panel positioned adjacent to the second and third plasma display panels, wherein each of the first, second, third, and fourth plasma display panels includes a front substrate on which a plurality of front electrodes are disposed, a back substrate on which a plurality of address electrodes are disposed to cross the plurality of front electrodes, and a plurality of barrier ribs positioned between the front substrate and the back substrate, the plurality of barrier ribs configured to partition a plurality of discharge cells, wherein a first address electrode of the plurality of address electrodes of the first plasma display panel includes a first portion and a second portion that has a width greater than a width of the first portion and is closer to the third plasma display panel than the first portion, wherein a second address electrode of the plurality of address electrodes of the first plasma display panel is disposed closer to the second plasma display panel than the first address electrode, wherein a minimum width of the second address electrode is greater than the width of the first portion of the first address electrode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

According to various embodiments of the invention, any one or more features from one embodiment/example/variation of the invention can be applied to (e.g., added, substituted, modified, etc.) any one or more other embodiments/examples/variations discussed below according to the invention. Further any operations/methods discussed below can be implemented in any of these devices/units or other suitable devices/units.

Figure 1:
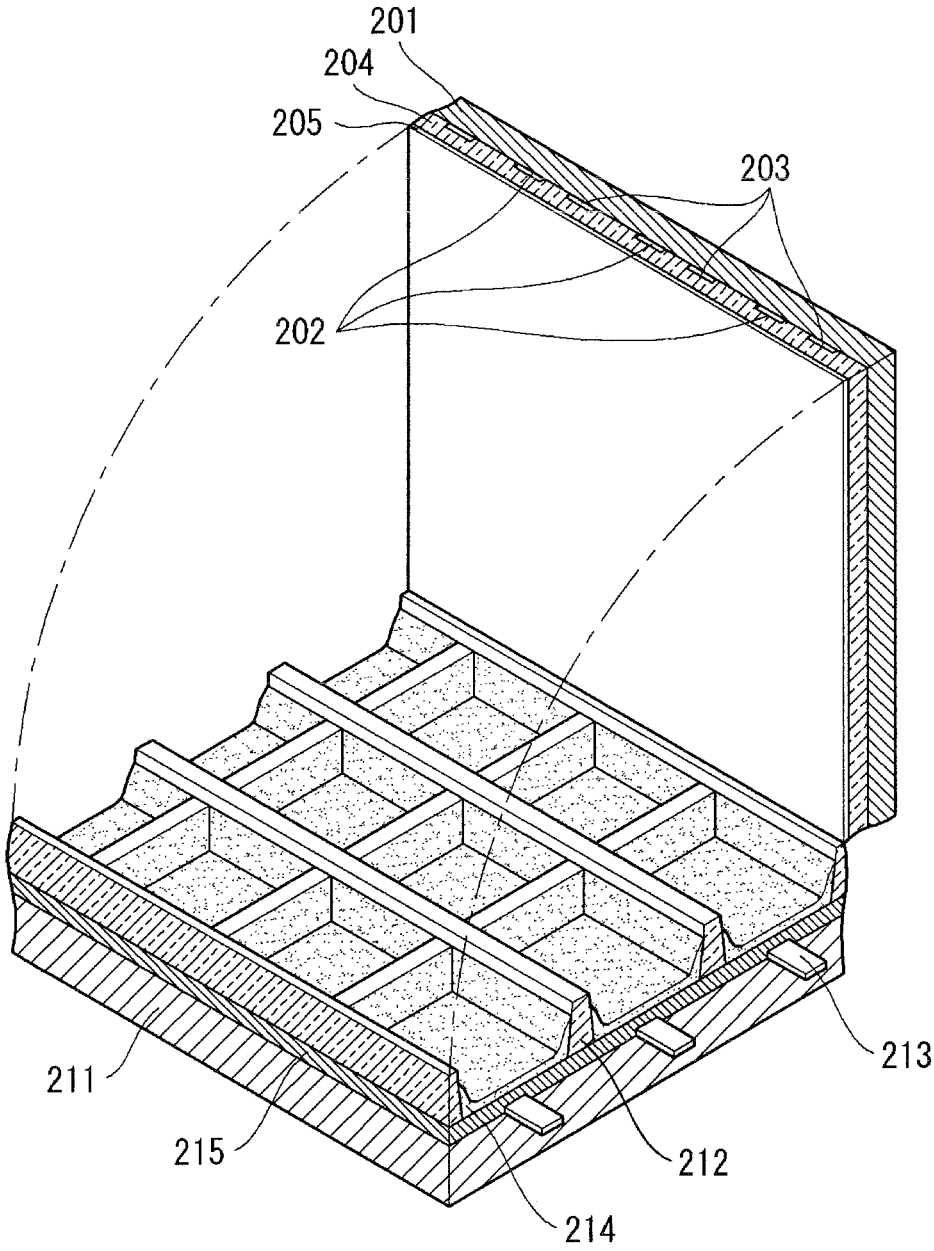
FIGS. 1 to 3 illustrate a structure and a driving method of a plasma display panel according to an exemplary embodiment of the invention.
Figure 2:
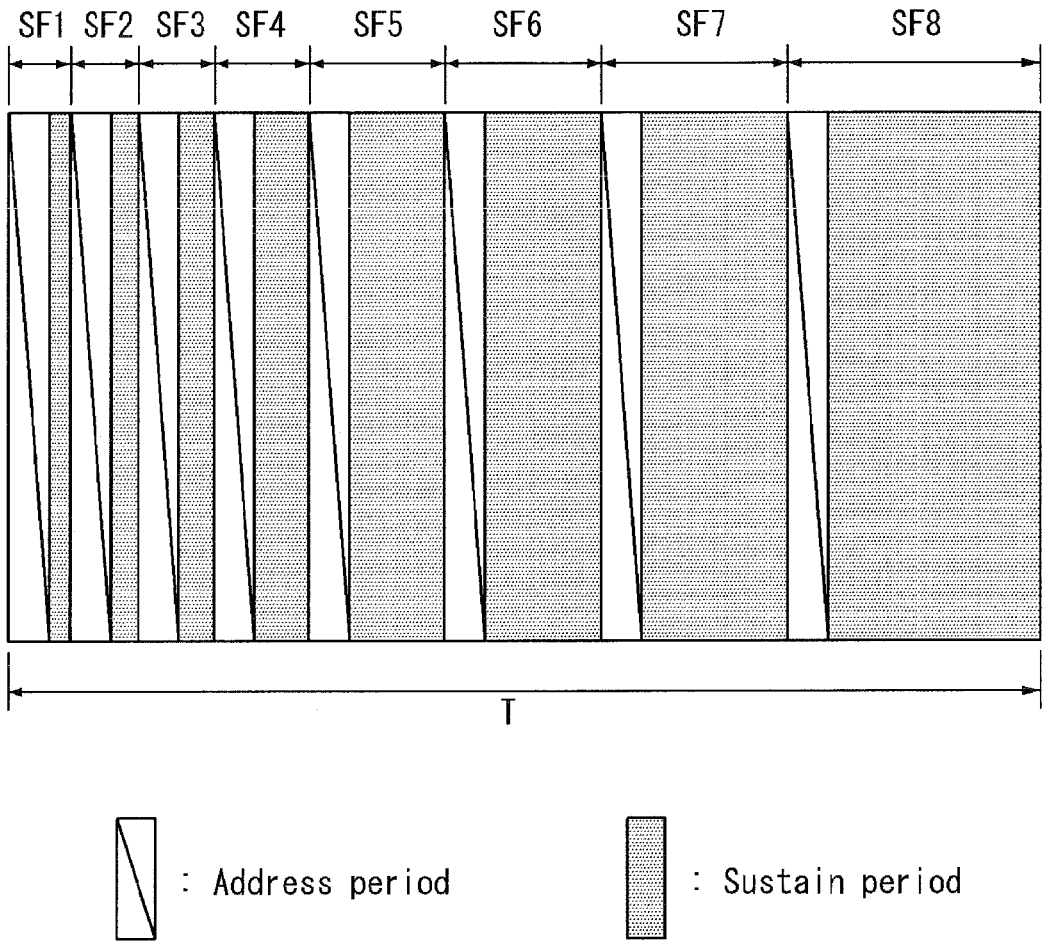
Figure 3:
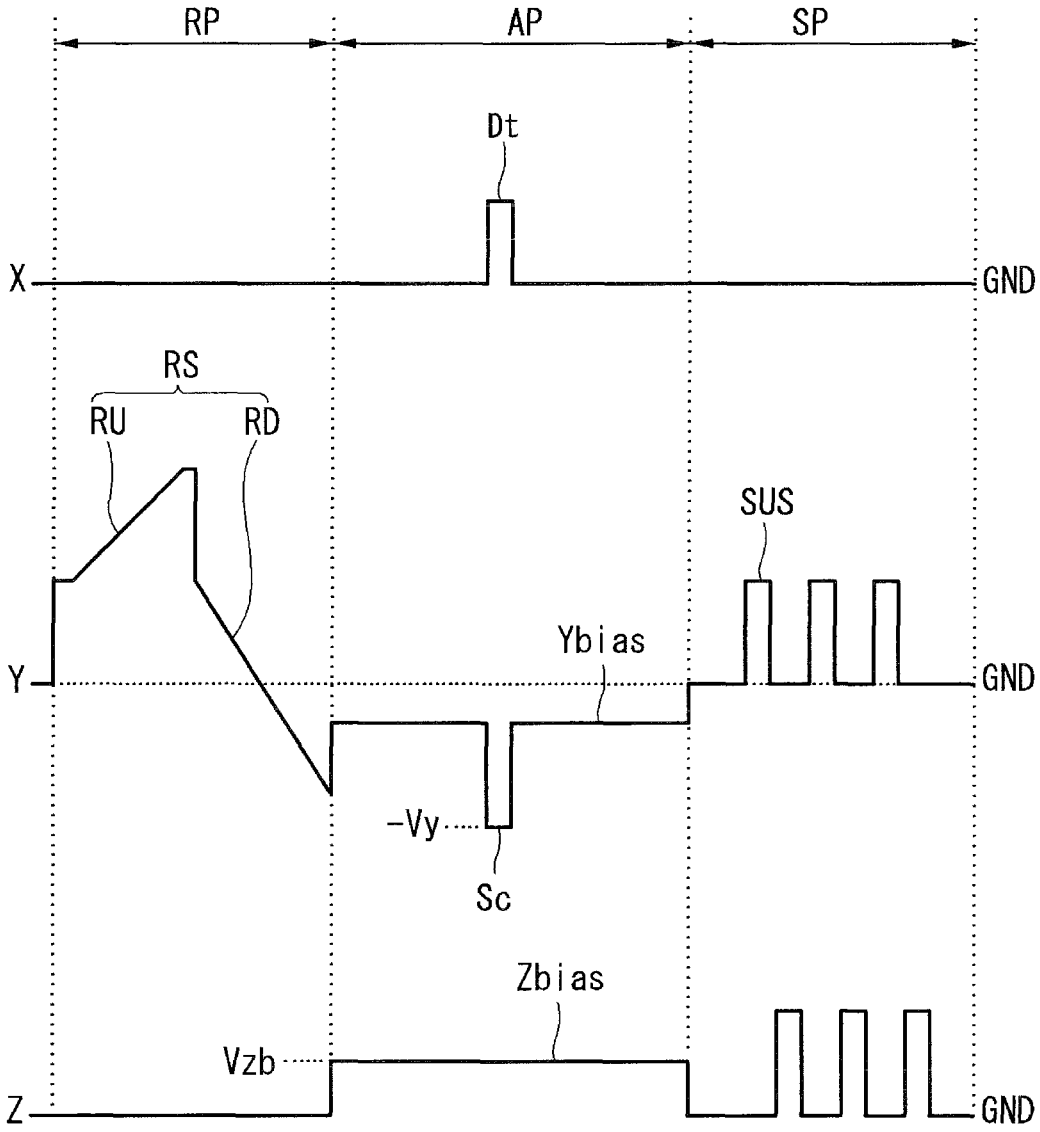

FIGS. 1 to 3 illustrate a structure and a driving method of a plasma display panel according to an exemplary embodiment of the invention.

A plasma display panel may display an image in a frame including a plurality of subfields.

More specifically, as shown in FIG. 1, the plasma display panel may include a front substrate 201, on which a plurality of first electrodes 202 and 203 are formed, and a back substrate 211 on which a plurality of second electrodes 213 are formed to cross the first electrodes 202 and 203.

In FIGS. 1 to 3, the first electrodes 202 and 203 may include scan electrodes 202 and sustain electrodes 203 substantially parallel to each other, and the second electrodes 213 may be called address electrodes.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203.

A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to provide discharge spaces (i.e., discharge cells). Hence, a first discharge cell emitting red light, a second discharge cell emitting blue light, and a third discharge cell emitting green light, etc. may be formed between the front substrate 201 and the back substrate 211. Each of the barrier ribs 212 may include first and second barrier ribs each having a different height.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells provided by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

A frame for achieving a gray scale of an image displayed on the plasma display panel is described with reference to FIG. 2.

As shown in FIG. 2, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 2, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^0$ and a gray level of a second subfield at $2^1$, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 2 shows that one frame includes 8 subfields, the number of subfields constituting a frame may vary. For example, a frame may include 10 or 12 subfields. Further, although FIG. 2 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

A driving waveform for driving the plasma display panel is illustrated in FIG. 3.

As shown in FIG. 3, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.1 μs, . . . , 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS may be alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

FIGS. 4 to 15 illustrate an exemplary structure of a discharge cell.

In the embodiment of the invention, the size of the discharge cell in a middle region of the plasma display panel may be less than the size of the discharge cell in an edge region of the plasma display panel.

In other words, the size of the discharge cell in a first region of the plasma display panel may be less than the size of the discharge cell in a second region outside the first region. In the embodiment of the invention, the size of the discharge cell may indicate the of the discharge cell partitioned by the barrier ribs 212.

Figure 4:
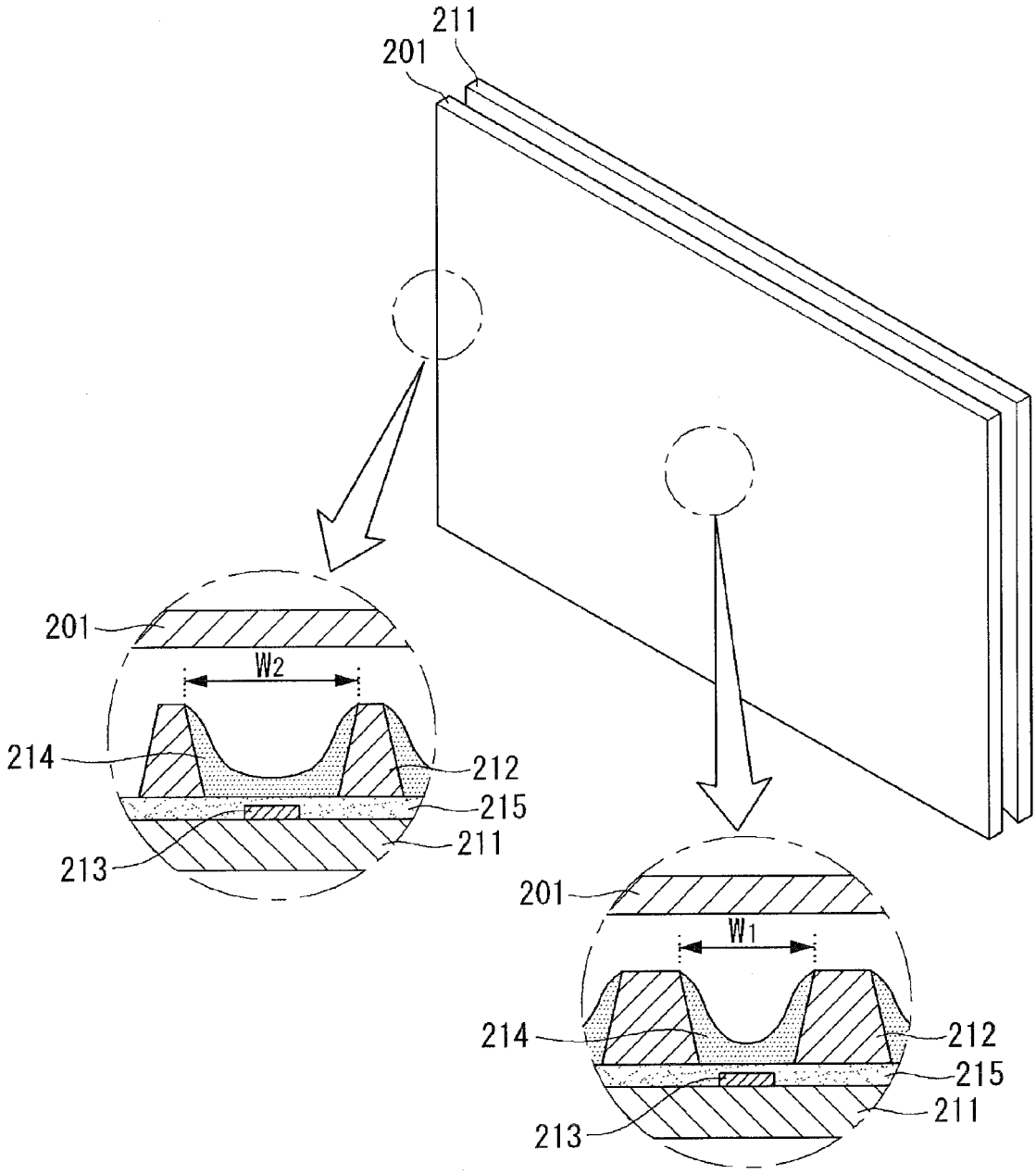
FIGS. 4 to 15 illustrate an exemplary structure of a discharge cell.
Figure 5:
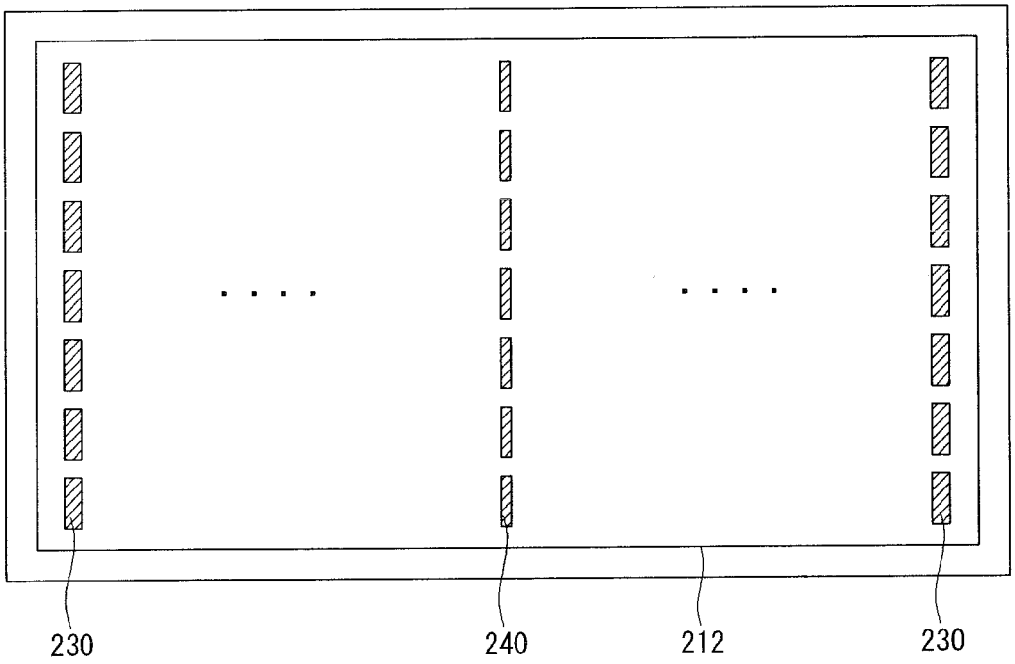

For example, as shown in FIGS. 4 and 5, a width W1 of the discharge cell in the middle region of the plasma display panel may be less than a width W2 of the discharge cell in the edge region of the plasma display panel in a direction crossing the address electrode 213. In other words, the width W1 of the discharge cell in the middle region of the plasma display panel may be less than the width W2 of the discharge cell in the edge region of the plasma display panel in a horizontal direction. Preferably, a width of an outermost discharge cell may be greater than a width of the discharge cell in the middle region of the plasma display panel in the direction crossing the address electrode 213.

Figure 6:
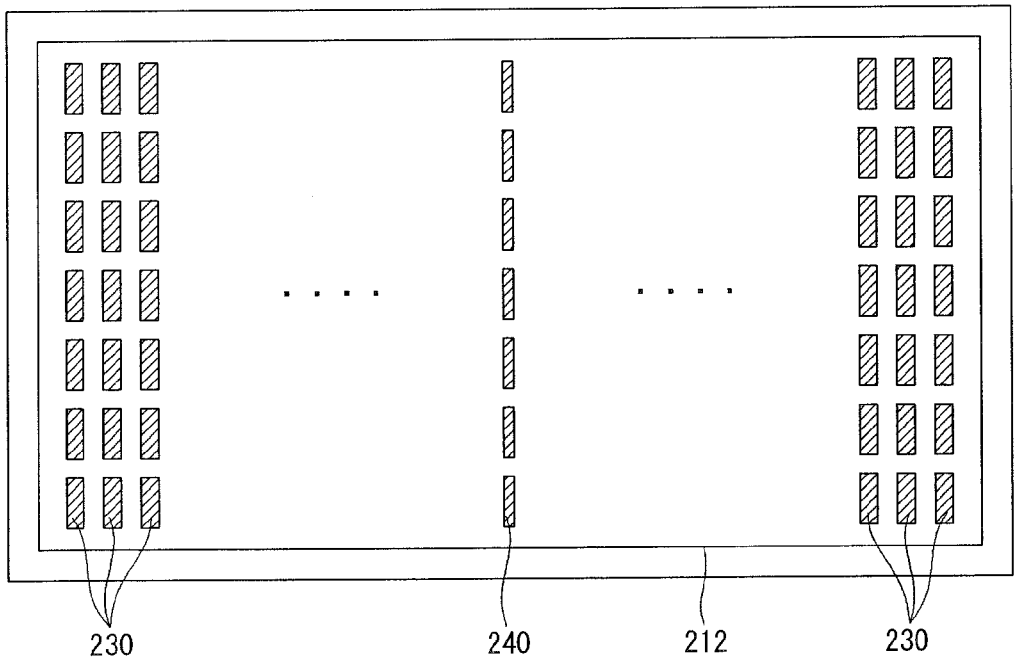

As shown in FIGS. 5 and 6, the size (for example, a transverse width W2) of a second discharge cell 230 positioned in the edge region of the plasma display panel may be greater than the size (for example, a transverse width W1) of a first discharge cell 240 positioned in the middle region of the plasma display panel.

Alternatively, as shown in FIG. 6, the plurality of second discharge cells 230 having the size greater than the size of the first discharge cell 240 may be positioned in the edge region of the plasma display panel.

A reason why the size of the second discharge cell 230 positioned in the edge region of the plasma display panel is greater than the size of the first discharge cell 240 positioned in the middle region of the plasma display panel is described below.

A method for manufacturing the plasma display panel may include a process for exhausting an impurity gas and a process for injecting the discharge gas. More specifically, after the front substrate 201 is attached to the back substrate 211, an impurity gas remaining in a space between the front substrate 201 and the back substrate 211 may be exhausted to the outside of the plasma display panel using an exhaust device such as a vacuum pump. Then, a discharge gas may be injected into the space between the front substrate 201 and the back substrate 211.

In the exhaust process, an exhaust amount of the impurity gas may vary depending on a connection location of the exhaust device, i.e., a location of an exhaust hole. For example, a remaining possibility of the impurity gas in the edge region of the panel is greater than a remaining possibility of the impurity gas in the middle region of the panel because of the structural characteristics of the panel. In particular, a remaining possibility of the impurity gas in the corner of the panel is greater than the remaining possibility of the impurity gas in the edge region of the panel.

Further, the injection uniformity of the discharge gas injected in the injection process may vary depending on a location of the panel. More specifically, because the discharge gas is easily circulated in the middle region of the panel, the injection uniformity of the discharge gas may be relatively good. On the other hand, the injection uniformity of the discharge gas in the edge region of the panel may be less than the injection uniformity of the discharge gas in the middle region of the panel because of the structural characteristics of the edge region of the panel. As a result, the discharge cells positioned in the edge region of the panel may perform an unstable discharge operation and also may be turned off.

Accordingly, the plasma display panel according to the embodiment of the invention may be configured, so that the size of the discharge cell 230 positioned in the edge region of the panel is greater than the size of the discharge cell 240 positioned in the middle region of the panel, thereby stabilizing a discharge operation of the discharge cell 230 positioned in the edge region. A width of the barrier rib 212 may be adjusted, so that the size of the discharge cell 230 positioned in the edge region is greater than the size of the discharge cell 240 positioned in the middle region.

Figure 7:
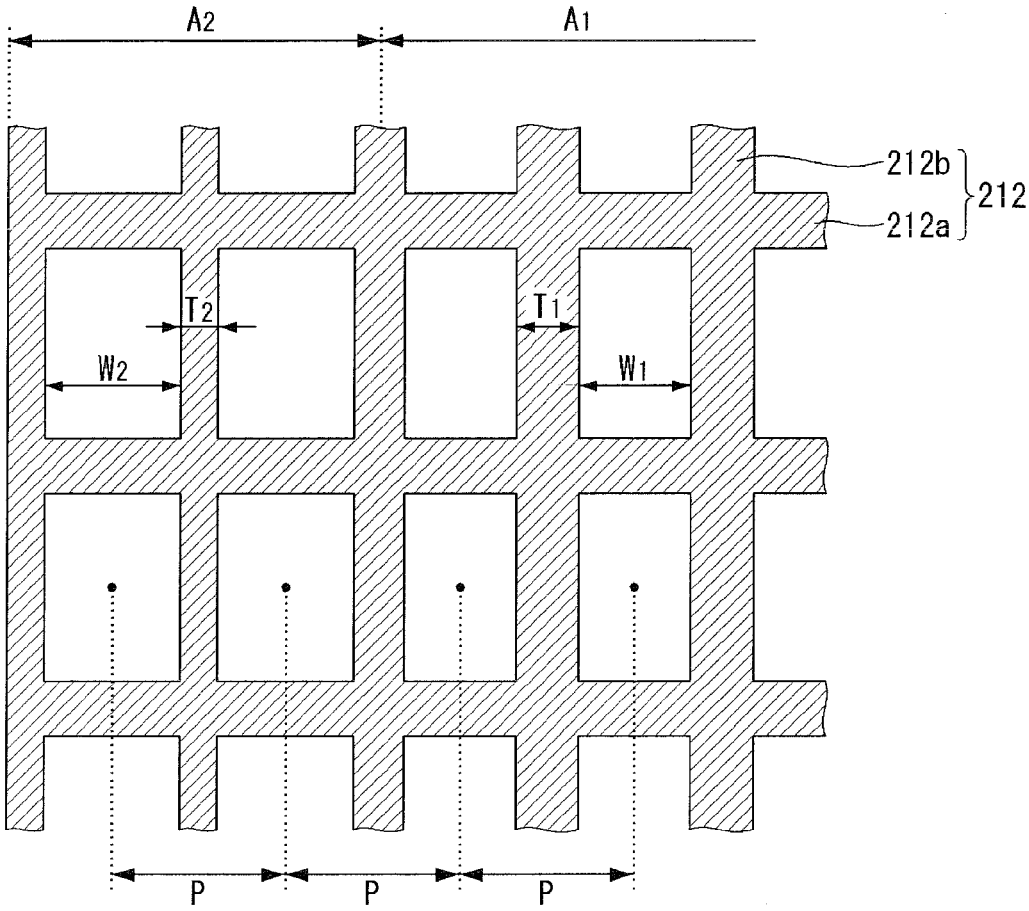

As shown in FIG. 7, the size of the second discharge cell 230 positioned in the edge region (i.e., a second region A2) of the panel may increase by reducing a width of the barrier rib 212 positioned in the second region A2 of the panel. Hence, the size of the second discharge cell 230 may be greater than the size of the first discharge cell 240. Preferably, when the barrier rib 212 includes a first barrier rib 212*a* positioned parallel to the first electrodes 202 and 203 (refer to FIG. 1) and a second barrier rib 212*b* positioned parallel to the second electrodes 213 (refer to FIG. 1), a width of the second barrier rib 212*b* positioned in the second region A2 may decrease. Hence, a width T2 of the second barrier rib 212*b* in the second region A2 may be less than a width T1 of the second barrier rib 212*b* in the middle region (i.e., a first region A1) of the panel. As a result, a width W2 of the second discharge cell 230 measured in a direction parallel to the first barrier 212*a* in the second region A2 may be greater than a width W1 of the first discharge cell 240 measured in a direction parallel to the first barrier 212*a* in the first region A1.

Because the size of the second discharge cell 230 increases by reducing the width of the second barrier rib 212*b* as shown in FIG. 7, a distance P between middle points of the two adjacent discharge cells may be uniform. For example, a distance P between middle points of the two adjacent second discharge cells 230 may be substantially equal to a distance P between middle points of the two adjacent first discharge cells 240. In the embodiment of the invention, the distance P between the middle points of the two adjacent discharge cells may be referred to as a pitch of the discharge cell.

Figure 8:
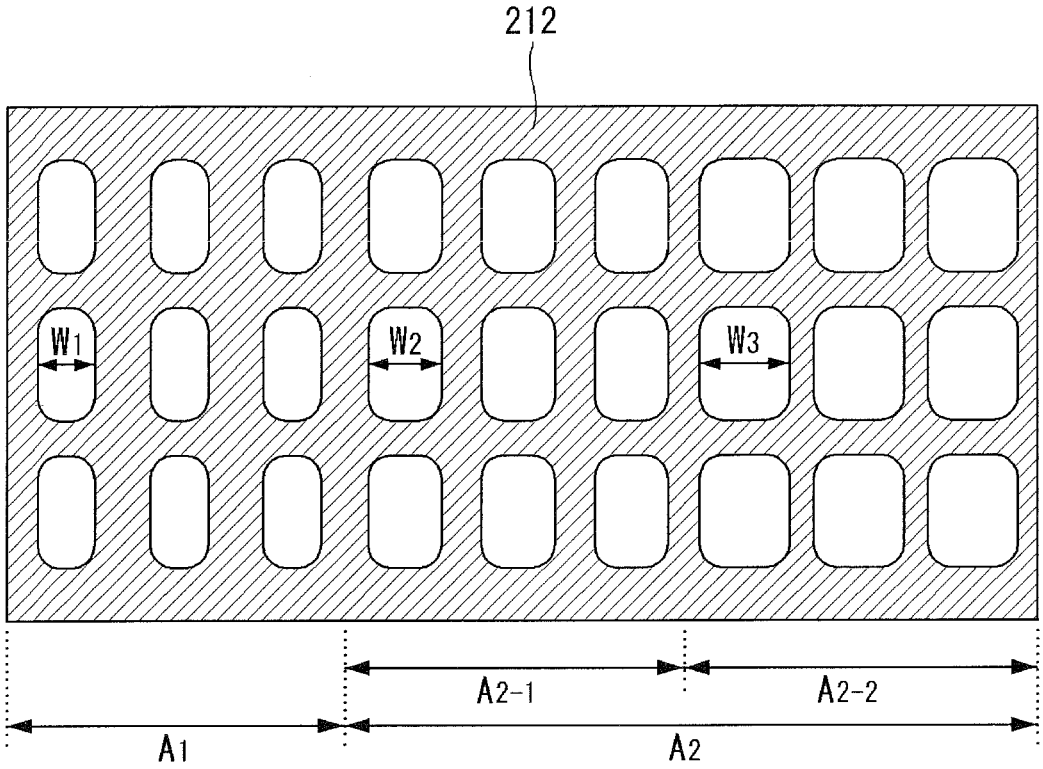

Alternatively, as shown in FIG. 8, the size of the second discharge cell 230 in the second region A2 may gradually increase. More specifically, the second region A2 may include a 2-1 region A2-1 outside the first region A1 and a 2-2 region A2-2 outside the 2-1 region A2-1. A width W2 of the discharge cell measured in the direction parallel to the first electrode in the 2-1 region A2-1 may be greater than a width W1 of the discharge cell measured in the direction parallel to the first electrode in the first region A1. Further, a width W3 of the discharge cell measured in the direction parallel to the first electrode in the 2-2 region A2-2 may be greater than the width W2 of the discharge cell in the 2-1 region A2-1. Namely, the size of the discharge cell may gradually increase as the discharge cell goes from the middle to the edge of the plasma display panel.

Figure 9:
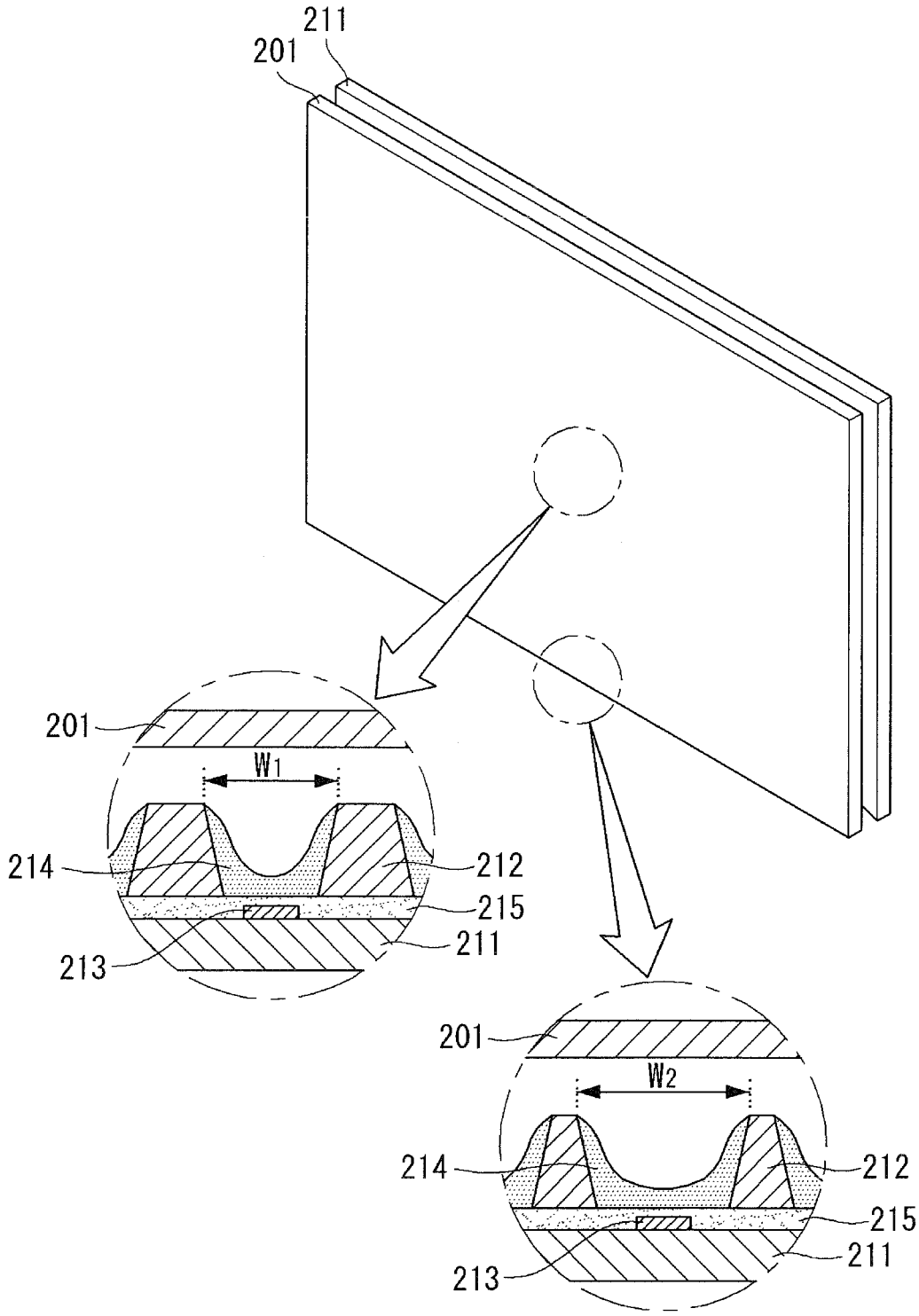
Figure 10:
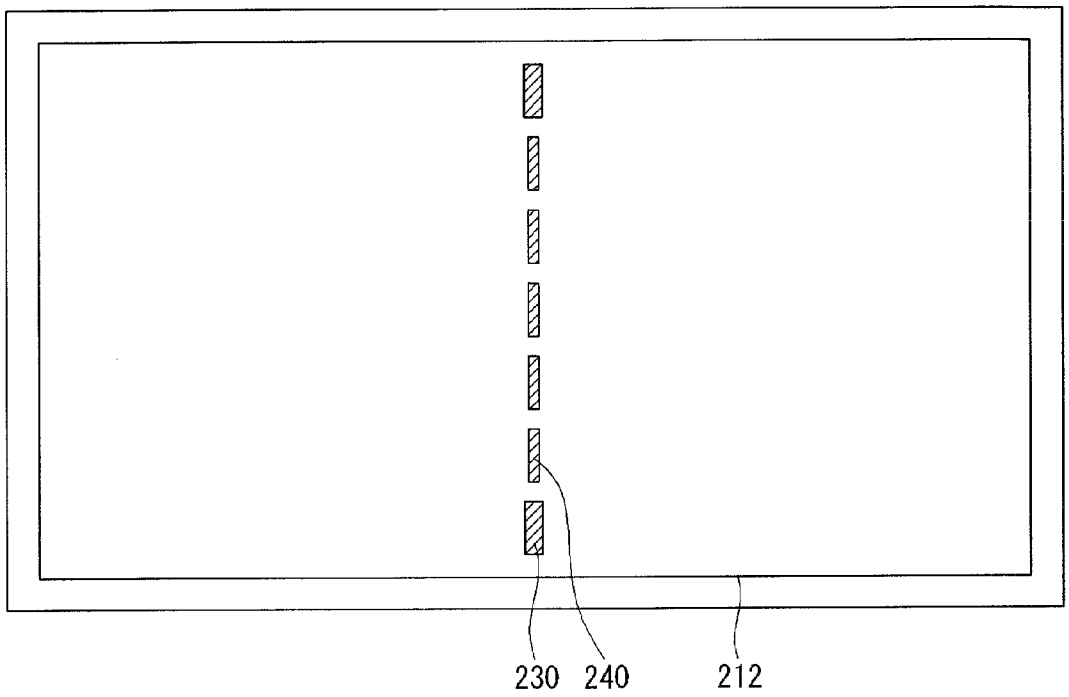

As shown in FIGS. 9 and 10, the size of the second discharge cell 230 measured in a vertical direction of the panel (i.e., in a direction parallel to the address electrode 213) in the edge region may be greater than the size of the first discharge cell 240 measured in the vertical direction of the panel in the middle region. As above, the discharge operation of the second discharge cell 230 in the edge region may be stabilized by adjusting the size of the discharge cell in the vertical direction of the panel.

Figure 11:
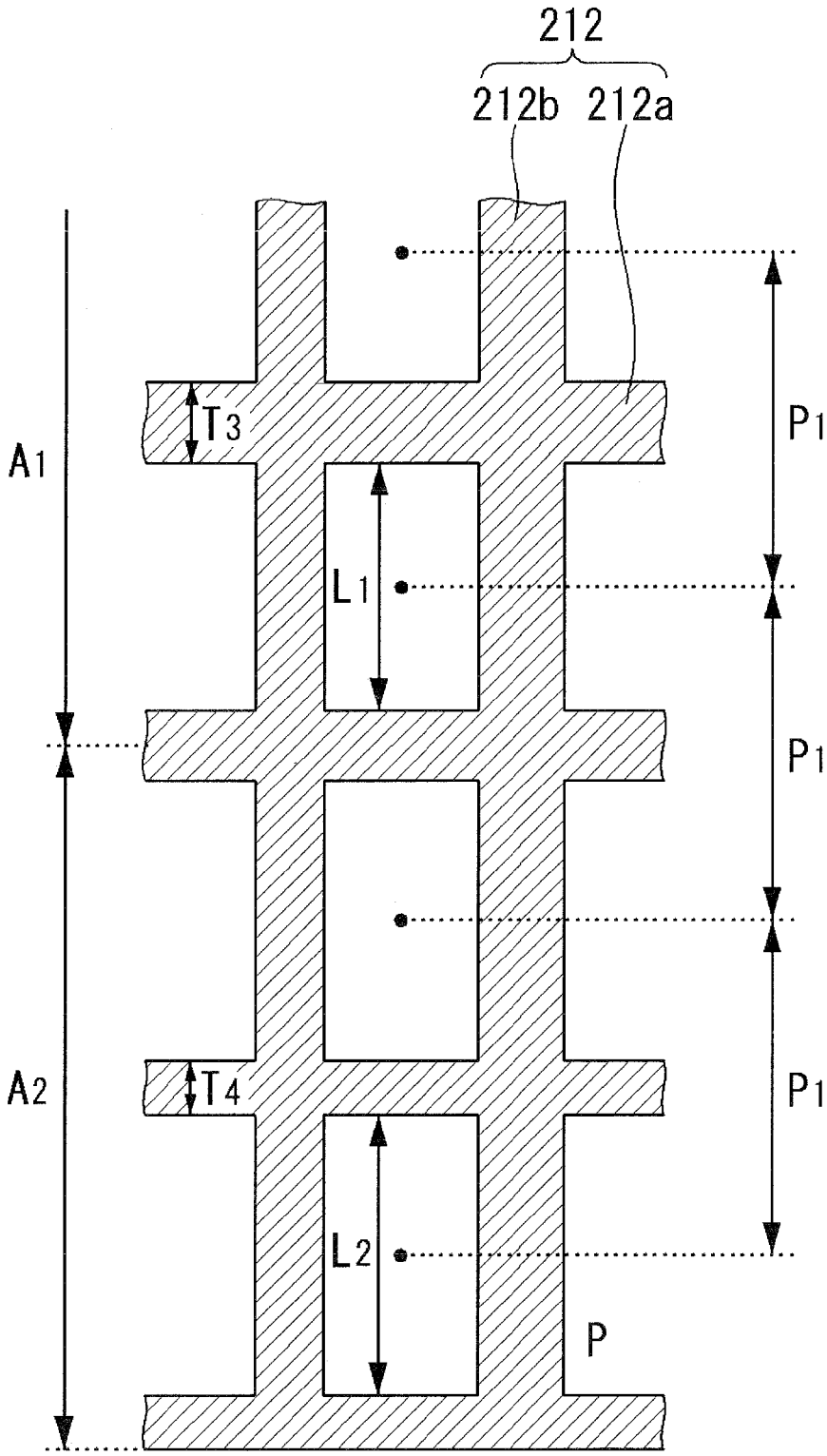

As shown in FIG. 11, the width of the first barrier rib 212*a* may be adjusted, so that the size of the second discharge cell 230 measured in the vertical direction of the panel in the edge region is greater than the size of the first discharge cell 240 measured in the vertical direction of the panel in the middle region.

For example, a width L2 of the discharge cell measured in a direction parallel to the second barrier rib 212*b* in the second region A2 may be greater than a width L1 of the discharge cell measured in the direction parallel to the second barrier rib 212*b* in the first region A1 by setting a width T4 of the first barrier rib 212*a* in the second region A2 to be less than a width T3 of the first barrier rib 212*a* in the first region A1.

As above, because the size of the discharge cell in the second region A2 increases by reducing the width of the first barrier rib 212*a* in the second region A2, the distance P1 between the middle points of the two adjacent discharge cells in the direction parallel to the second barrier rib 212*b* may be uniform.

Figure 12:
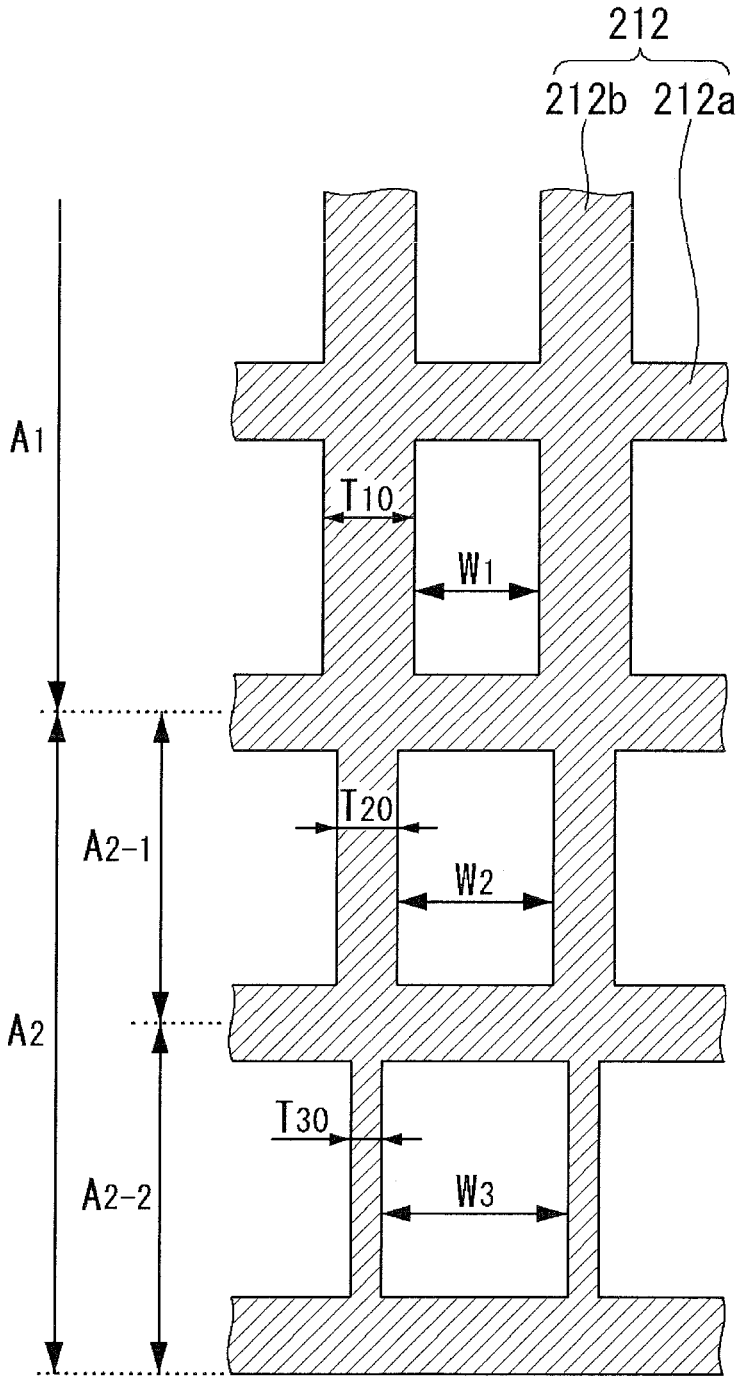
Figure 13:
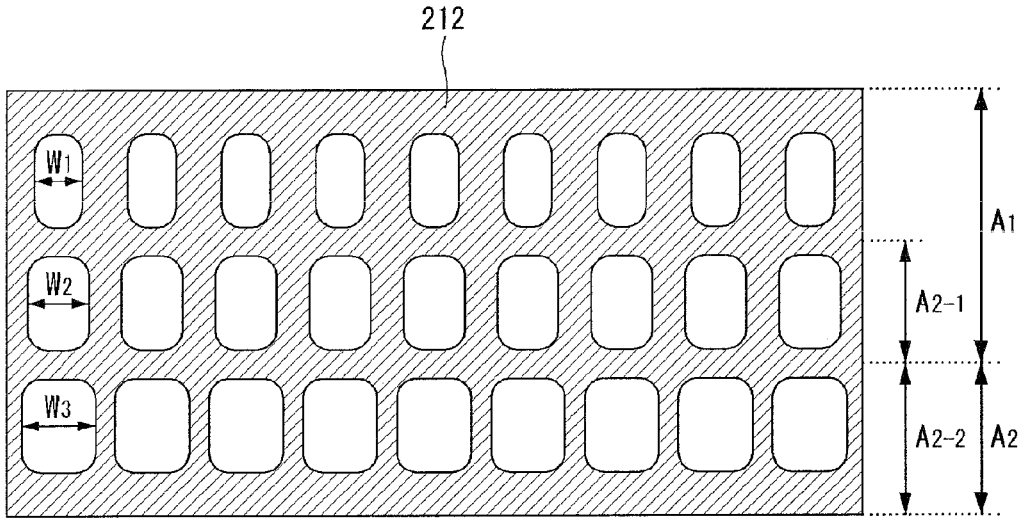

Alternatively, as shown in FIGS. 12 and 13, the width of the second barrier rib 212*b* may be adjusted, so that the size of the second discharge cell 230 measured in the vertical direction of the panel in the edge region is greater than the size of the first discharge cell 240 measured in the vertical direction of the panel in the middle region.

For example, the size of the second discharge cell 230 in the second region A2 may gradually increase by gradually reducing the width of the second barrier rib 212*b* in the second region A2.

In other words, the width W2 of the discharge cell measured in the direction parallel to the first electrode in the 2-1 region A2-1 positioned in the direction parallel to the second electrode (i.e., in the direction parallel to the second barrier rib 212*b*) may be greater than the width W1 of the discharge cell measured in the direction parallel to the first electrode in the first region A1. Further, the width W3 of the discharge cell measured in the direction parallel to the first electrode in the 2-2 region A2-2 outside the 2-1 region A2-1 in the direction parallel to the second barrier rib 212*b* may be greater than the width W2 of the discharge cell measured in the direction parallel to the first electrode in the 2-1 region A2-1. Namely, the size of the discharge cell may gradually increase as the discharge cell goes from the middle to the edge of the plasma display panel in the direction parallel to the second barrier rib 212*b*.

Figure 14:
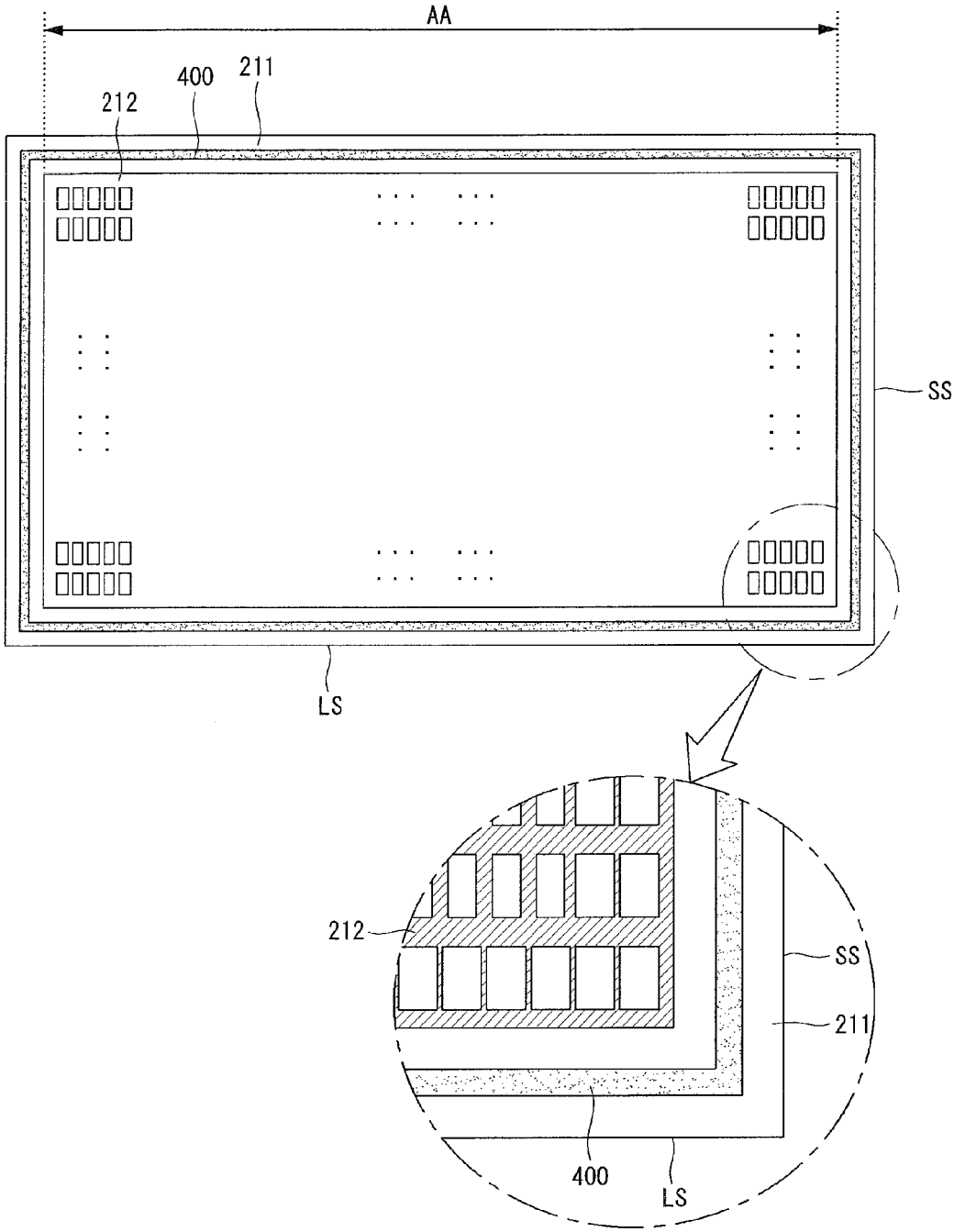

Further, as shown in FIG. 14, the size of the discharge cell in the edge region may be greater than the size of the discharge cell in the middle region in the vertical and horizontal directions of the panel.

In the embodiment of the invention, the vertical direction of the panel may be a direction parallel to a short side SS of the back substrate 211, and the horizontal direction of the panel may be a direction parallel to a long side LS of the back substrate 211.

Figure 15:
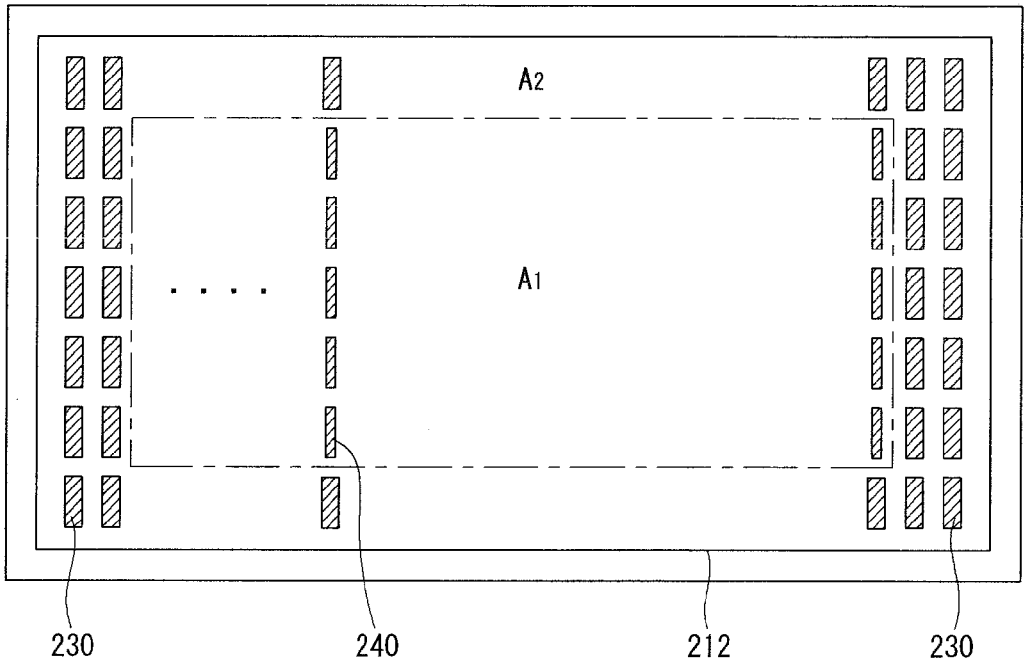

The size of the discharge cell in the edge region may be greater than the size of the discharge cell in the middle region in the direction of the long side LS of the back substrate 211. Further, the size of the discharge cell in the edge region may be greater than the size of the discharge cell in the middle region in the direction of the short side SS of the back substrate 211. In other words, as shown in FIG. 15, the size of the first discharge cell 240 in the first region A1 may be less than the size of the second discharge cell 230 in the second region A2. Hence, the discharge operation of the discharge cells positioned in the edge region in the vertical and horizontal directions of the panel may be stabilized.

FIGS. 16 to 25 illustrate an exemplary configuration of a multi plasma display panel according to an exemplary embodiment of the invention. Structures and components identical or equivalent to those illustrated in FIGS. 1 to 15 are designated with the same reference numerals, and a further description may be briefly made or may be entirely omitted. For example, a multi plasma display panel may use the plasma display panel illustrated in FIGS. 1 to 15.

Figure 16:
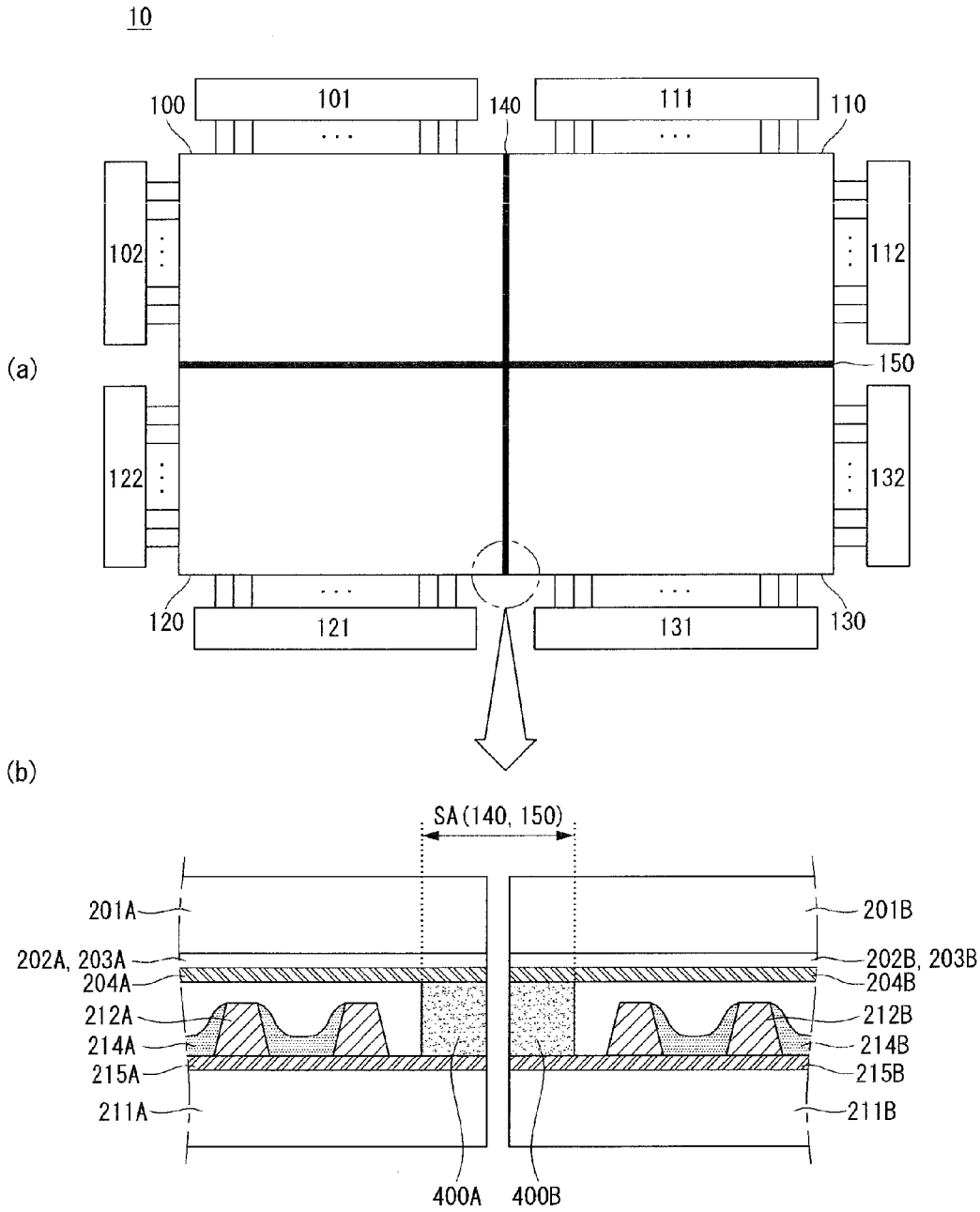
FIGS. 16 to 25 illustrate an exemplary configuration of a multi plasma display panel according to an exemplary embodiment of the invention.

As shown in FIG. 16(*a*), a multi plasma display panel 10 according to an exemplary embodiment of the invention may include a plurality of plasma display panels 100, 110, 120, and 130 that are positioned adjacent to one another.

A 1-1 driver 101 and a 1-2 driver 102 may supple driving signals to the first plasma display panel 100 of the plurality of plasma display panels 100, 110, 120, and 130. The 1-1 display panel 100 of the plurality of plasma display panels 100, 110, 120, and 130. The 1-1 driver 101 and the 1-2 driver 102 may be integrated into one driver. Further, a 2-1 driver 111 and a 2-2 driver 112 may supply driving signals to the second plasma display panel 110. In other words, the multi plasma display panel 10 may be configured so that the plasma display panels 100, 110, 120, and 130 receive the driving signal from different drivers, respectively.

Figure 19:
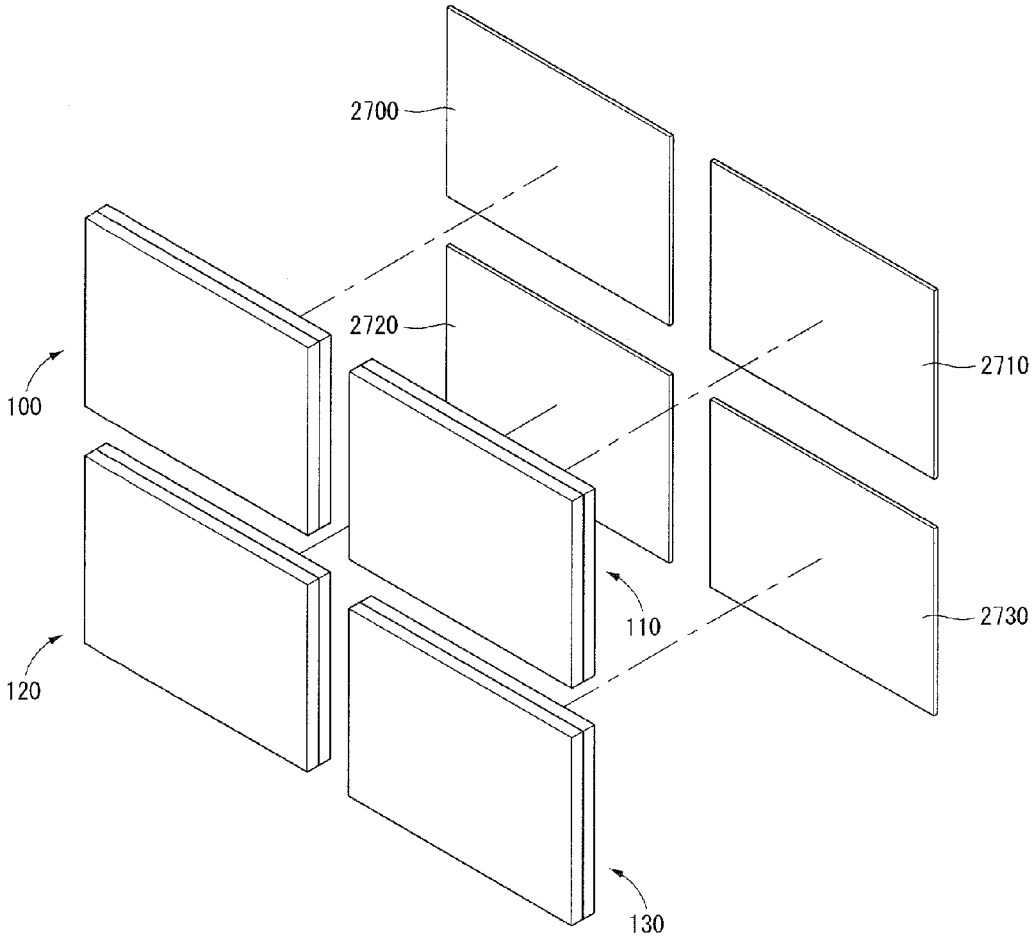

For example, as shown in FIG. 19, a first main frame 2700 may be disposed on a back surface of the first panel 100, i.e., a back surface of a back substrate of the first panel 100, a second main frame 2710 may be disposed on a back surface of the second panel 110, a third main frame 2720 may be disposed on a back surface of the third panel 120, and a fourth main frame 2730 may be disposed on a back surface of the fourth panel 130.

The first to fourth main frames 2700, 2710, 2720, and 2730 may respectively include driving boards for supplying the driving signals to the first to fourth panels 100, 110, 120, and 130.

As shown in FIG. 16(*b*), seam portions 140 and 150 may be formed between the two adjacent plasma display panels. The seam portions 140 and 150 may indicate regions between the two adjacent plasma display panels. Because the multi plasma display panel 10 displays an image on the plasma display panels 100, 110, 120, and 130 positioned adjacent to one another, the seam portions 140 and 150 may be formed between the two adjacent plasma display panels.

A method for manufacturing the multi plasma display panel 10 is described below.

Figure 17:
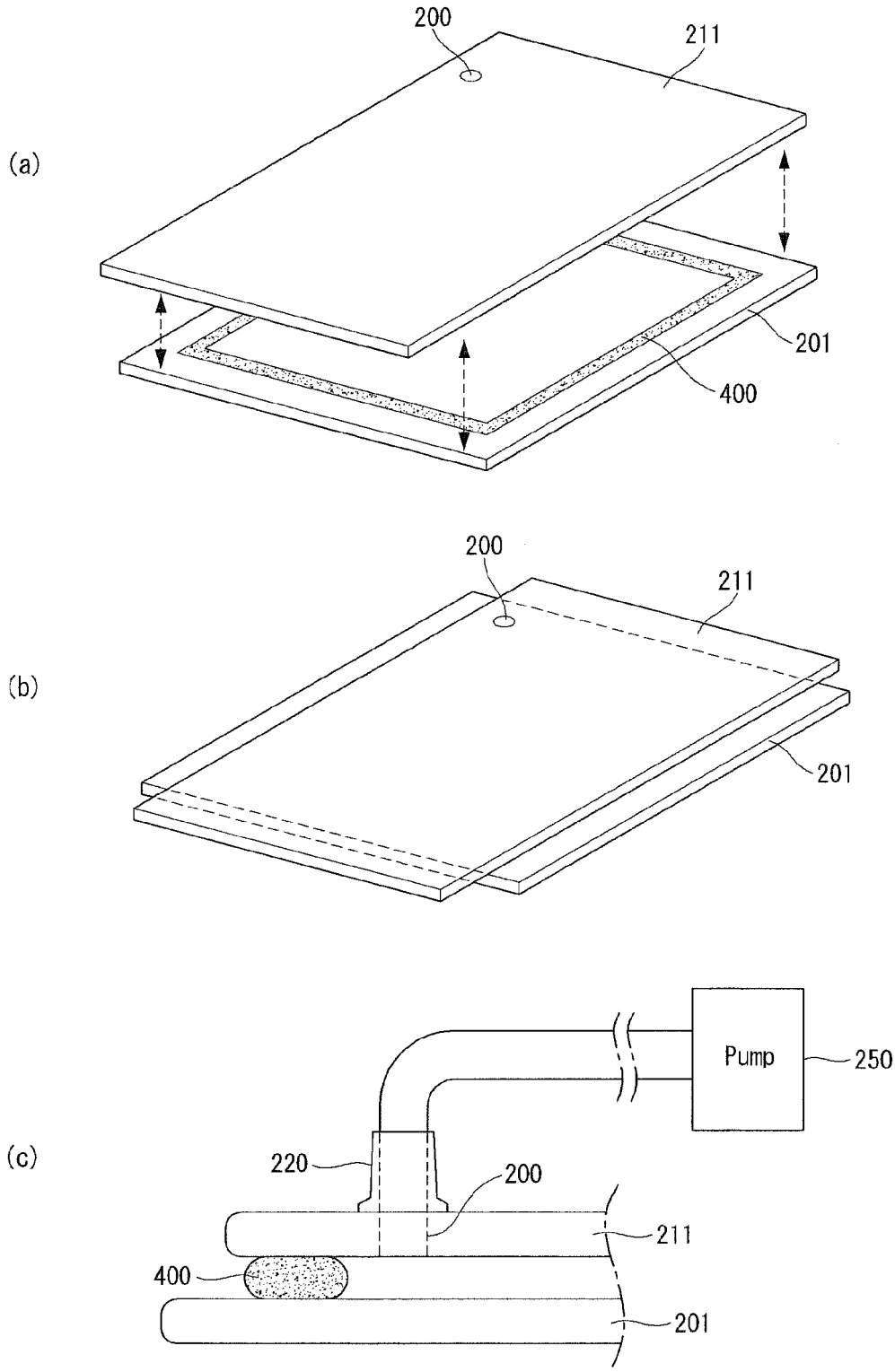

As shown in FIG. 17(*a*), a seal layer 400 may be formed along an edge of the back substrate 211. Although FIG. 17(*a*) shows the seal layer 400 on the back substrate 211, the seal layer 400 may be formed on at least one of the front substrate 201 and the back substrate 211.

Next, as shown in FIG. 17(*b*), the front substrate 201 and the back substrate 211 may be attached to each other.

Next, as shown in FIG. 17(*c*), an exhaust tip 220 may be connected to an exhaust hole 200, and an exhaust pump 230 may be connected to the exhaust tip 220. The exhaust pump 230 may exhaust an impurity gas remaining in a discharge space between the front substrate 201 and the back substrate 211 to the outside and may inject a discharge gas such as argon (Ar), neon (Ne), and xenon (Xe) into the discharge space.

Figure 18:
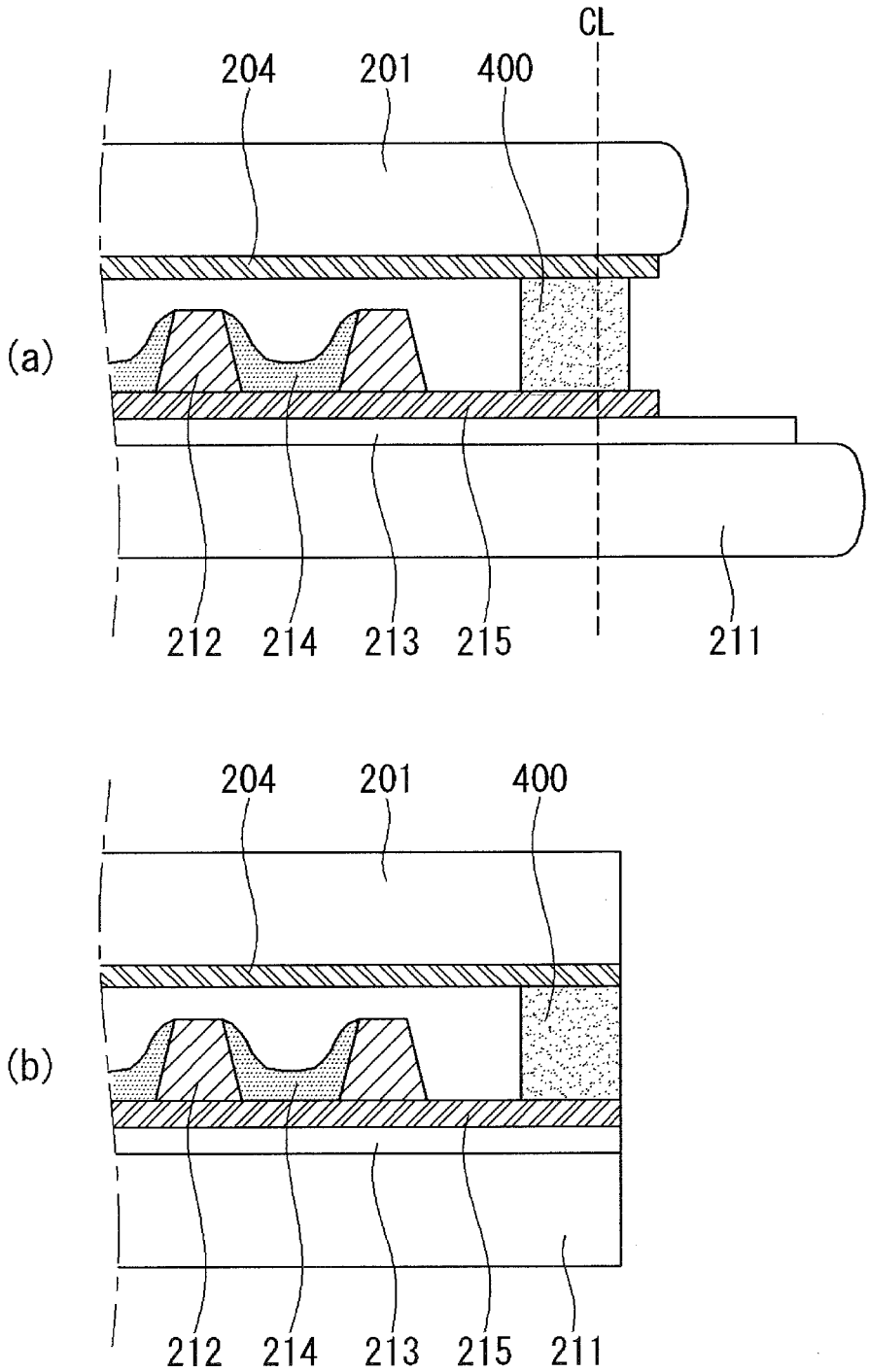

Next, as shown in FIG. 18(*a*), the front substrate 201 and the back substrate 211 positioned outside the seal layer 400 may be cut along a predetermined cutting line CL. In this instance, a portion of the seal layer 400 may be cut along with a portion of each of the front substrate 201 and the back substrate 211. Hence, as shown in FIG. 18(*b*), the size of a portion of the panel on which the image is not displayed may be reduced, and the size of a bezel area may be reduced. As a result, the size of each of the seam portions 140 and 150 of the multi plasma display panel 10 may be reduced.

Figure 20:
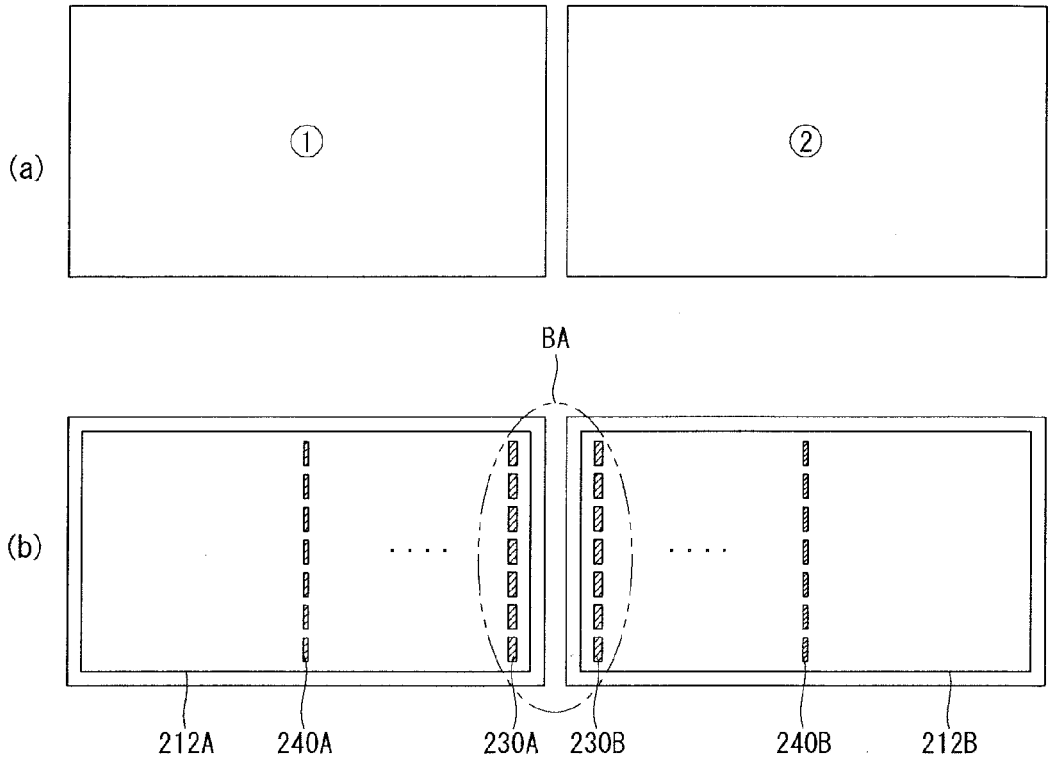

As shown in FIG. 20, the size of the discharges cells positioned in a boundary region BA between two panels ① and ② of the multi plasma display panel 10, that are positioned adjacent to each other in a horizontal direction, i.e., in a direction crossing the address electrode 213, may be greater than the size of the discharge cells positioned in a middle region of each of the two adjacent panels ① and ②. In other words, the size of a first discharge cell 240A in a first region of the first panel ① may be less than the size of a second discharge cell 230A in a second region of the first panel ① that is closer to the second panel ② than the first region. Further, the size of a first discharge cell 240B in a third region of the second panel ② may be less than the size of a second discharge cell 230A in a fourth region of the second panel ② that is closer to the first panel ① than the third region.

An outermost discharge cell of the first panel ① may be positioned in the second region of the first panel ①, and an outermost discharge cell of the second panel ② may be positioned in the fourth region of the second panel ②. Further, at least one discharge cell adjacent to the outermost discharge cell of the first panel ① may be further positioned in the second region of the first panel ①, and at least one discharge cell adjacent to the outermost discharge cell of the second panel ② may be further positioned in the fourth region of the second panel ②.

The seam portion between the two adjacent panels ① and ② of the multi plasma display panel may reduce the image quality of the multi plasma display panel. Hence, the size of the edge region of the outermost discharge cell in the boundary region BA between the two adjacent panels ① and ② may decrease so as to reduce a width of the seam portion. However, when the size of the edge region of the outermost discharge cell in the boundary region BA decreases, the impurity gas may remain in the boundary region BA. Hence, the discharge cells positioned in the boundary region BA may perform the unstable discharge operation and may be turned off. As a result, the images may be discontinuously displayed on the two adjacent panels ① and ②, and the image quality of the multi plasma display panel may worsen.

On the other hand, as shown in FIG. 20, when the sizes of the second discharge cells 230A and 230B positioned in the boundary region BA between the two adjacent panels and are greater than the sizes of the first discharge cells 240A and 240B positioned in the middle regions of the panels ① and ②, the discharge operation in the boundary region BA may be stabilized. Hence, the image may be smoothly displayed on the two adjacent panels ① and ②. As a result, the image quality of the multi plasma display panel may be improved.

Accordingly, the plasma display panel illustrated in FIGS. 1 to 15 may be applied to the above-described multi plasma display panel 10.

Figure 21:
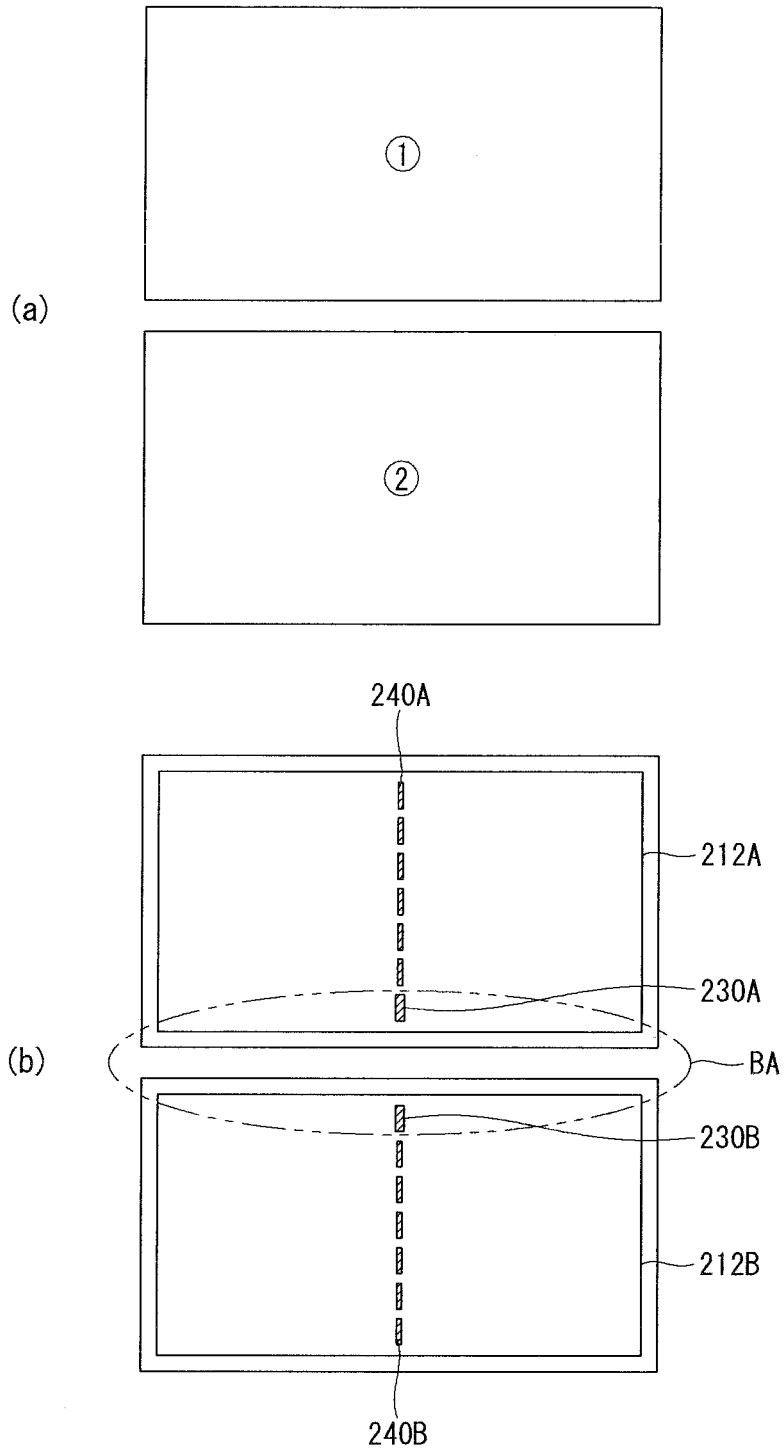

As shown in FIG. 21, sizes of second discharge cells 230A and 230B positioned in a boundary region BA between two panels ① and ② of the multi plasma display panel 10, that are positioned adjacent to each other in a vertical direction, i.e., in a direction parallel to the address electrode 213, may be greater than sizes of first discharge cells 240A and 240B positioned in middle regions of the panels ① and ②. Hence, the image quality of the multi plasma display panel 10 may be improved.

Alternatively, the sizes of second discharge cells 230A and 230B positioned in a boundary region between two panels of the multi plasma display panel 10, that are positioned adjacent to each other in both the vertical and horizontal directions, may be greater than sizes of first discharge cells 240A and 240B positioned in middle regions of the two panels.

Figure 22:
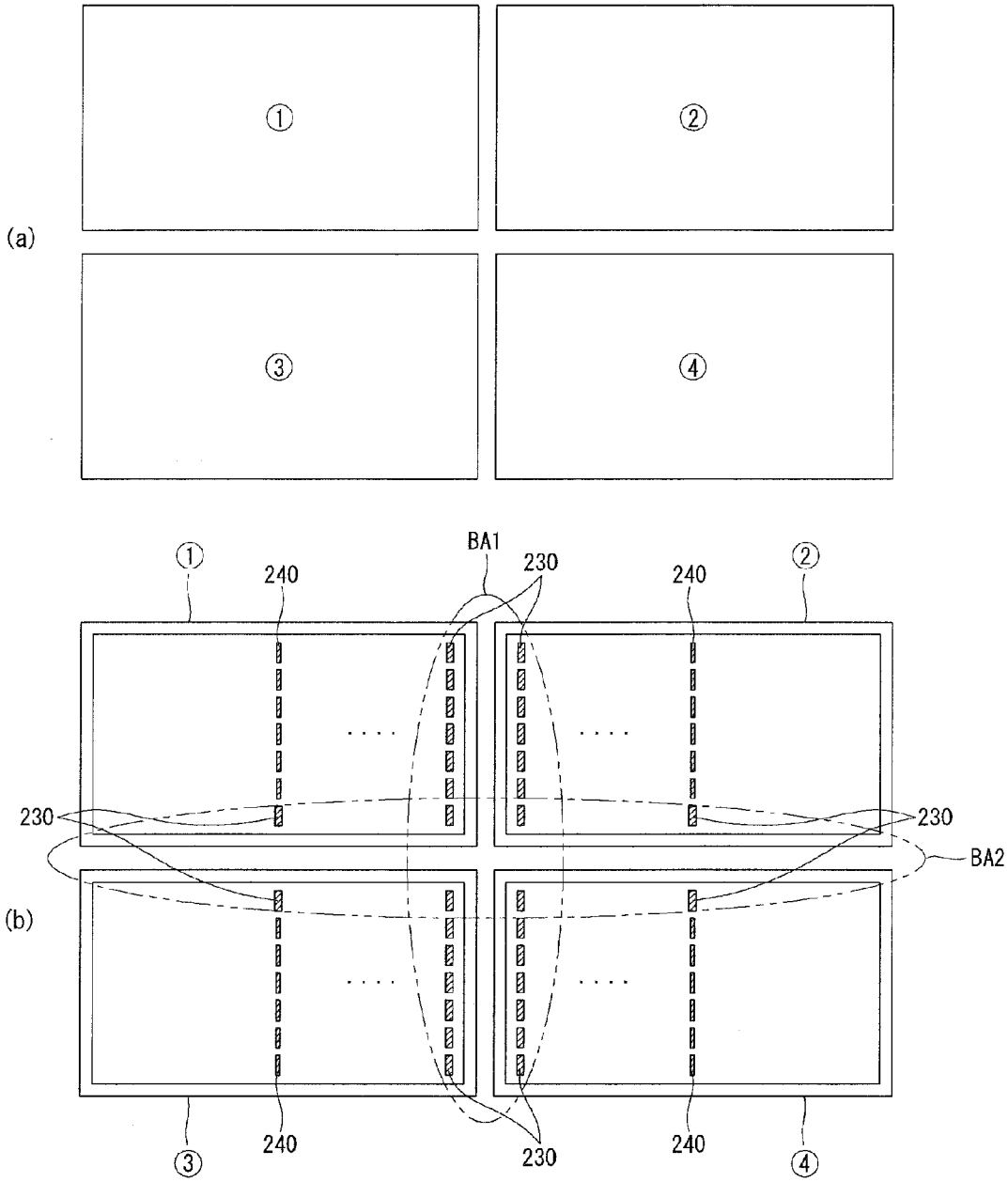

For example, as shown in FIG. 22(*a*), the multi plasma display panel 10 may include a first panel ①, a second panel ② positioned adjacent to the first panel ①, a third panel ③ positioned adjacent to the first panel ①, and a fourth panel ④ positioned adjacent to the second panel ② and the third panel ③.

As shown in FIG. 22(*b*), the size of the first discharge cells 240 in a first region of the first panel ① may be less than the size of the second discharge cells 230 in a second region of the first panel ①, that is closer to the second panel ② than the first region in the direction parallel to the first electrode, and the size of the second discharge cells 230 in a third region of the first panel ①, that is closer to the third panel ③ than the first region in the direction parallel to the second electrode. Outermost discharge cells may be positioned in the second and third regions of the first panel ①.

The width of the second discharge cell 230 measured in the direction parallel to the first electrode in the second region may be greater than the width of the first discharge cell 240 measured in the direction parallel to the first electrode in the first region. This may be the structure to which the structure illustrated in FIG. 7 is applied. In other words, the size of the discharge cell 230 in the second region of the first panel ① may increase by reducing the width of the second barrier rib 212*b* in the second region of the first panel ①.

Further, the width of the second discharge cell 230 measured in the direction parallel to the second electrode in the third region may be greater than the width of the first discharge cell 240 measured in the direction parallel to the second electrode in the first region. This may be the structure to which the structure illustrated in FIG. 11 is applied. In other words, the size of the discharge cell 230 in the third region of the first panel ① may increase by reducing the width of the first barrier rib 212*a* in the third region of the first panel ①.

The width of the second discharge cell 230 measured in the direction parallel to the first electrode in the third region may be greater than the width of the first discharge cell 240 measured in the direction parallel to the first electrode in the first region. This may be the structure to which the structure illustrated in FIG. 12 is applied. In other words, the size of the discharge cell 230 in the third region of the first panel ① may increase by reducing the width of the second barrier rib 212*b* in the third region of the first panel ①.

The above-described configurations applied to the first panel ① may be applied to the second, third, and fourth panels ②, ③, and ④.

Figure 23:
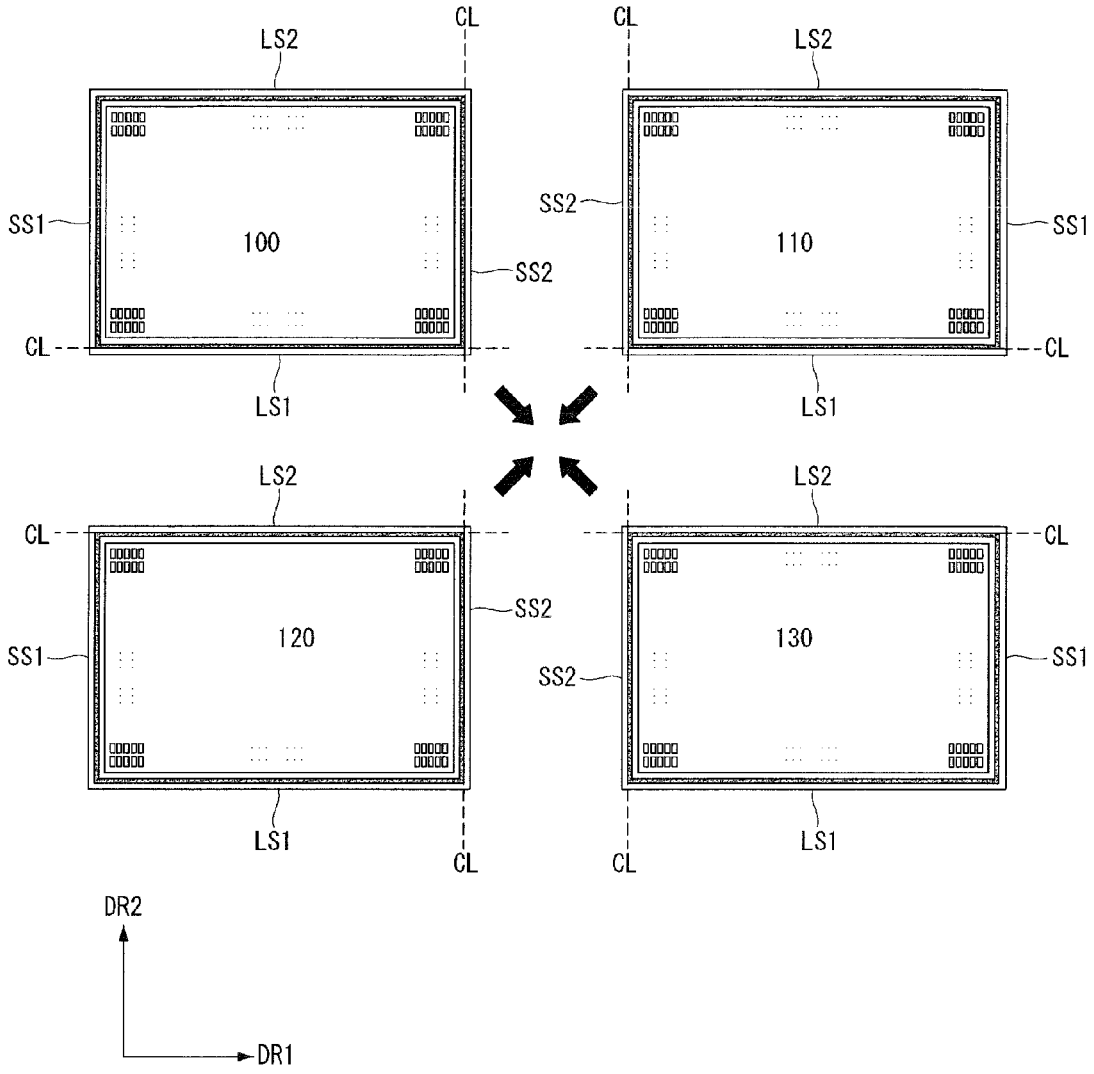

The plurality of plasma display panels may be disposed adjacent to one another to manufacture the multi plasma display panel. For example, as shown in FIG. 23, the first to fourth panels 100, 110, 120, and 130 may be arranged in a matrix structure of 2×2.

The first to fourth panels 100, 110, 120, and 130 may be disposed, so that cutting surfaces of the first to fourth panels 100, 110, 120, and 130 are adjacent to one another.

For example, a cutting process and a grinding process may be performed on a second short side SS2 and a second long side LS2 of each of the first to fourth panels 100, 110, 120, and 130.

More specifically, the first and second panels 100 and 110 may be disposed so that the second short side SS2 of the first panel 100 is adjacent to the second short side SS2 of the second panel 110. The third and fourth panels 120 and 130 may be disposed so that the second short side SS2 of the third panel 120 is adjacent to the second short side SS2 of the fourth panel 130. Further, the first and third panels 100 and 120 may be disposed so that the second long side LS2 of the first panel 100 is adjacent to the second long side LS2 of the third panel 120. The second and fourth panels 110 and 130 may be disposed so that the second long side LS2 of the second panel 110 is adjacent to the second long side LS2 of the fourth panel 130.

Unlike the embodiment of the invention, a viewer may view a discontinuous image displayed on a general multi plasma display panel because of a seam portion of the general multi plasma display panel.

On the other hand, in the embodiment of the invention, as shown in FIG. 23, when the first to fourth panels 100, 110, 120, and 130 are disposed so that the cutting surfaces of the first to fourth panels 100, 110, 120, and 130 are adjacent to one another, the size of the seam portions 140 and 150 of the multi plasma display panel 10 may be reduced. Hence, the viewer may view a natural image displayed on the multi plasma display panel 10.

Although the embodiment of the invention illustrates the first to fourth panels 100, 110, 120, and 130 having the matrix structure of 2×2, other arrangement structures may be used. For example, the plurality of plasma display panels may be arranged in a matrix structure of 1×2 or 2×1.

Figure 24:
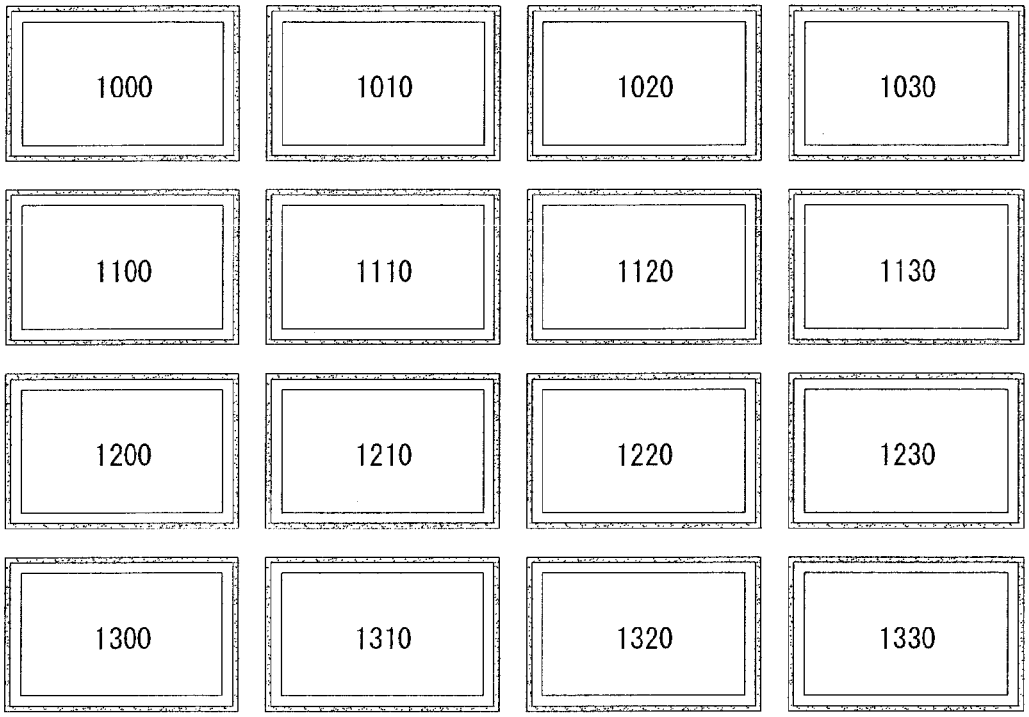

Alternatively, as shown in FIG. 24, the plurality of plasma display panels may be arranged in a matrix structure of 4×4. When the multi plasma display panel is manufactured using a large number of plasma display panels, the large number of plasma display panels may be disposed in the same pattern.

In plasma display panels 1000-1330 having the matrix structure of 4×4 shown in FIG. 24, for example, the first panel 1000, the second panel 1010, the fifth panel 1100, and the sixth panel 1110 are described with reference to FIG. 25.

Figure 25:
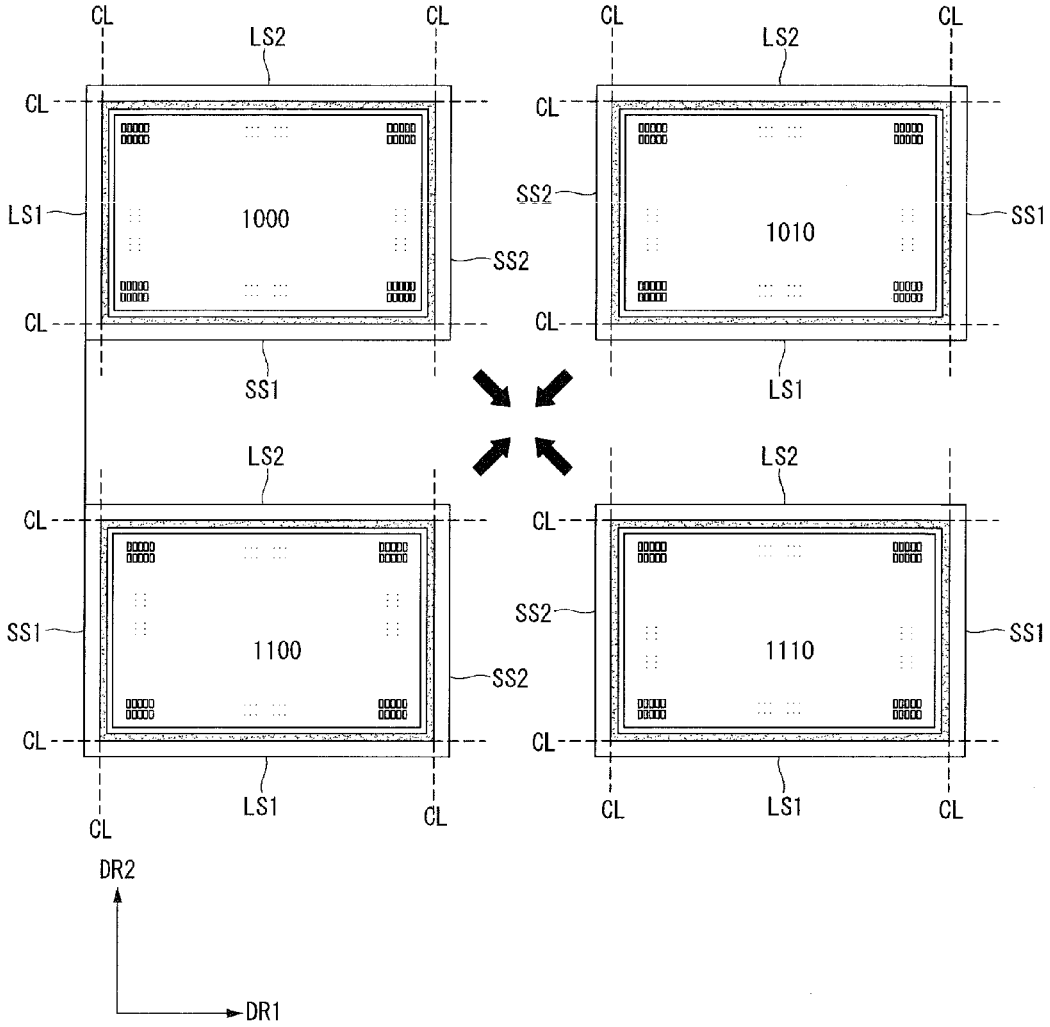

As shown in FIG. 25, the first panel 1000 and the second panel 1010 may be positioned adjacent to each other in a first direction DR1, the first panel 1000 and the fifth panel 1100 may be positioned adjacent to each other in a second direction DR2 crossing the first direction DR1, the sixth panel 1110 and the second panel 1010 may be positioned adjacent to each other in the second direction DR2, and the sixth panel 1110 and the fifth panel 1100 may be positioned adjacent to each other in the first direction DR1.

The cutting process and the grinding process may be performed on first and second short sides SS1 and SS2 and first and second long sides LS1 and LS2 of each of the first panel 1000, the second panel 1010, the fifth panel 1100, and the sixth panel 1110.

The first and second panels 1000 and 1010 may be disposed so that the second short side SS2 of the first panel 1000 and the first short side SS1 of the second panel 1010 are adjacent to each other. The fifth and sixth panels 1100 and 1110 may be disposed so that the second short side SS2 of the fifth panel 1100 and the first short side SS1 of the sixth panel 1110 are adjacent to each other. The first and fifth panels 1000 and 1100 may be disposed so that the second long side LS2 of the first panel 1000 and the first long side LS1 of the fifth panel 1100 are adjacent to each other. The second and sixth panels 1010 and 1110 may be disposed so that the second long side LS2 of the second panel 1010 and the first long side LS1 of the sixth panel 1110 are adjacent to each other.

FIGS. 26 to 36 illustrate an exemplary structure of the address electrode according to the embodiment of the invention.

In the embodiment of the invention, a width or a thickness of the address electrode in the middle region of the panel may be less than a width or a thickness of the address electrode in the edge region of the panel. In other words, a width of the address electrode 213 in the first region of the panel may be less than a width of the address electrode 213 in the second region of the panel outside the first region.

Figure 26:
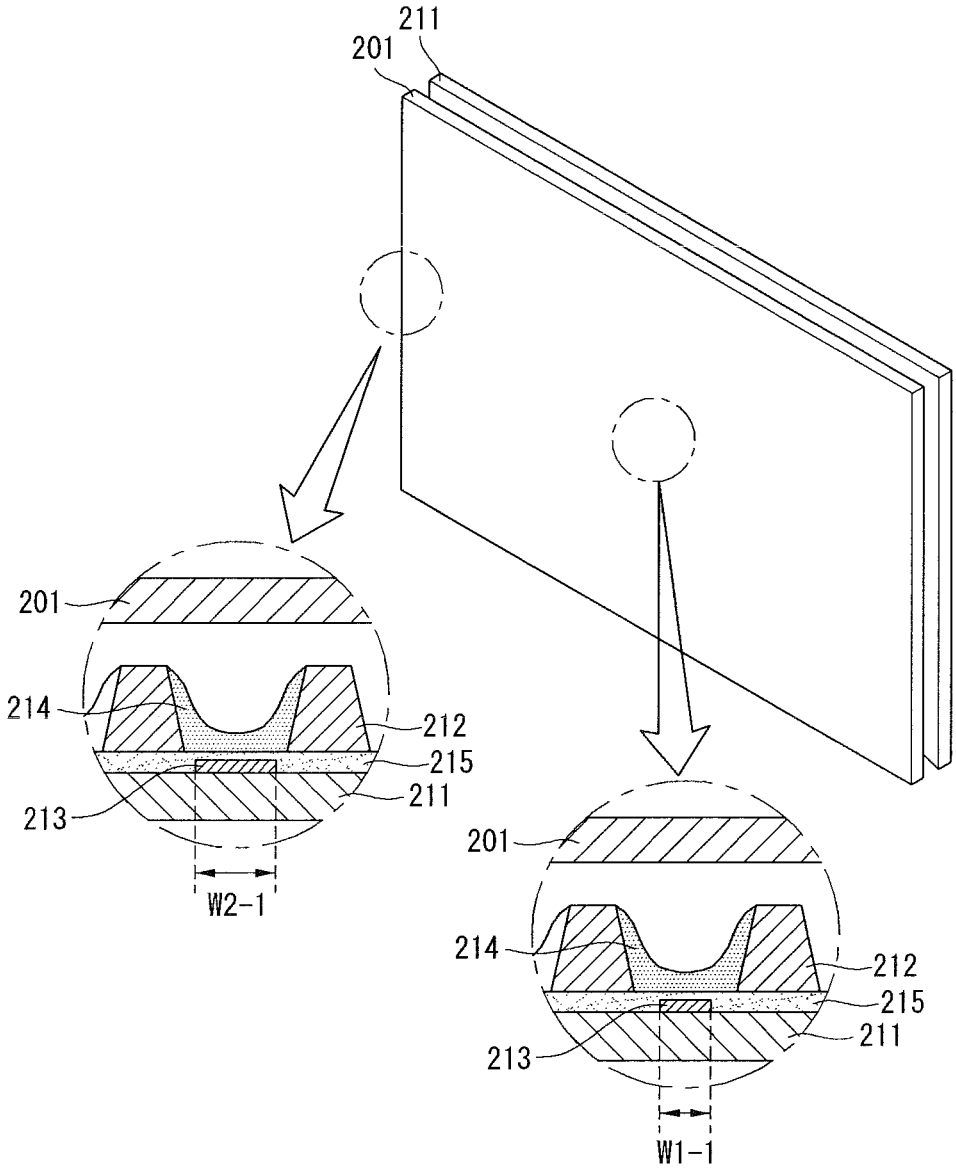
FIGS. 26 to 36 illustrate an exemplary structure of an address electrode.
Figure 27:
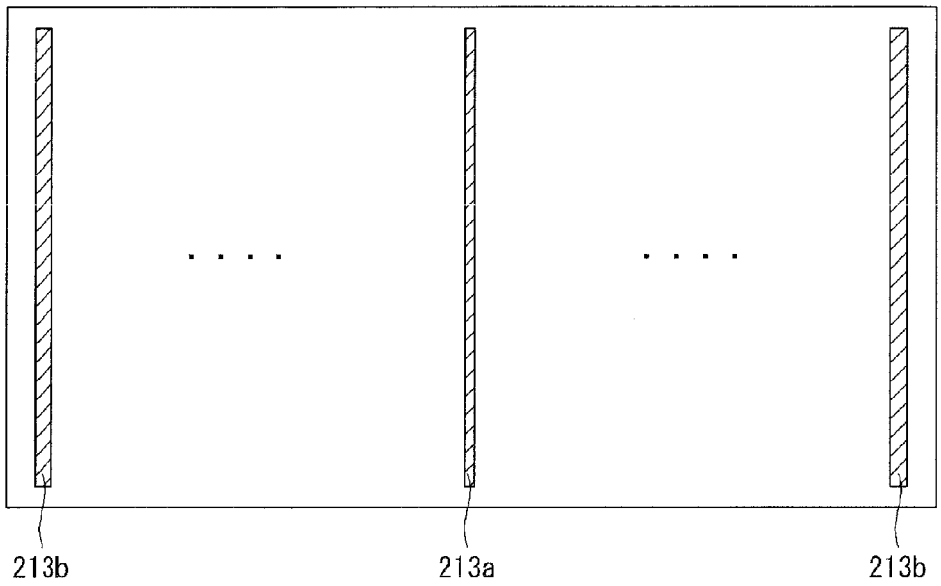

As shown in FIGS. 26 and 27, a width W1-1 of the address electrode 213 measured in a direction crossing the address electrode 231 in the middle region of the panel may be less than a width W2-1 of the address electrode 213 measured in the direction crossing the address electrode 231 in the edge region of the panel. Namely, the width W1-1 of the address electrode 213 measured in the horizontal direction in the middle region of the panel may be less than the width W2-1 of the address electrode 213 measured in the horizontal direction in the edge region of the panel.

Preferably, as shown in FIG. 27, a width of an outermost address electrode 213*b* of the panel in the direction crossing the address electrode 231 may be greater than the width W1-1 of the address electrode 213 measured in the direction crossing the address electrode 231 in the middle region of the panel.

As shown in FIG. 27, the outermost address electrode 213*b* may be positioned in an area overlapping an outermost discharge cell.

Figure 28:
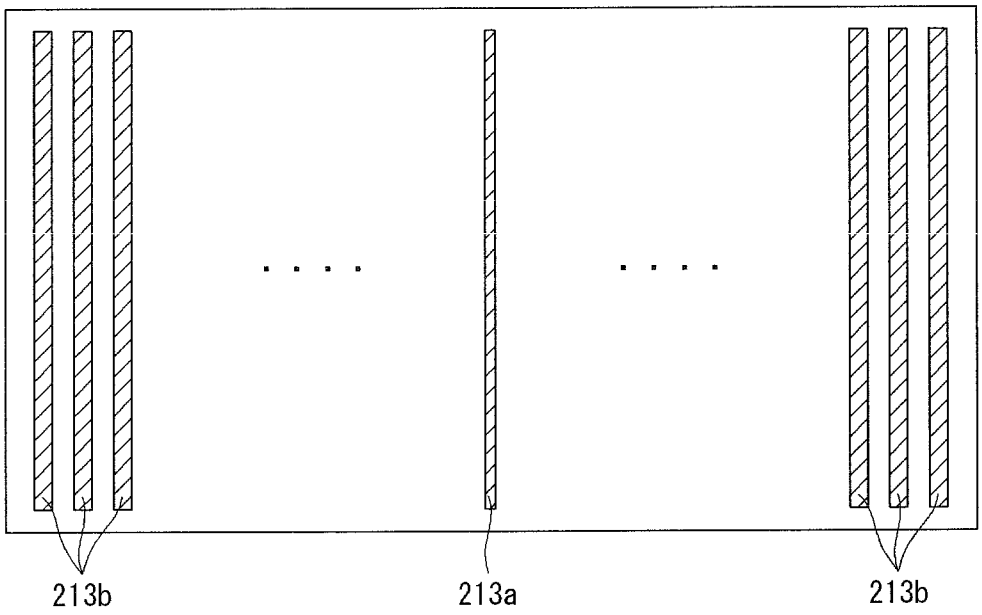

Alternatively, as shown in FIG. 28, a width of each of the plurality of second address electrodes 213*b* positioned in the edge region of the panel may be greater than a width of the first address electrodes 213*a* positioned in the middle region of the panel. Namely, the number of address electrodes having the relatively large width may be plural.

A reason why the width of the address electrode positioned in the edge region of the panel may be greater than a width of the address electrode positioned in the middle region of the panel is described below.

A method for manufacturing the plasma display panel may include a process for exhausting an impurity gas and a process for injecting the discharge gas. More specifically, after the front substrate 201 is attached to the back substrate 211, an impurity gas remaining in a space between the front substrate 201 and the back substrate 211 may be exhausted to the outside of the plasma display panel using an exhaust device such as a vacuum pump. Then, a discharge gas may be injected into the space between the front substrate 201 and the back substrate 211.

In the exhaust process, an exhaust amount of the impurity gas may vary depending on a connection location of the exhaust device, i.e., a location of an exhaust hole. For example, a remaining possibility of the impurity gas in the edge region of the panel is greater than a remaining possibility of the impurity gas in the middle region of the panel because of the structural characteristics of the panel. In particular, a remaining possibility of the impurity gas in the corner of the panel is greater than the remaining possibility of the impurity gas in the edge region of the panel.

Further, the injection uniformity of the discharge gas injected in the injection process may vary depending on a location of the panel. More specifically, because the discharge gas is easily circulated in the middle region of the panel, the injection uniformity of the discharge gas may be relatively good. On the other hand, the injection uniformity of the discharge gas in the edge region of the panel may be less than the injection uniformity of the discharge gas in the middle region of the panel because of the structural characteristics of the edge region of the panel. As a result, the discharge cells positioned in the edge region of the panel may perform an unstable discharge operation and also may be turned off.

Accordingly, the plasma display panel according to the embodiment of the invention may be configured, so that the width of the address electrode positioned in the edge region of the panel is greater than the width of the address electrode positioned in the middle region of the panel, thereby stabilizing the discharge operation of the discharge cell positioned in the edge region.

Figure 29:
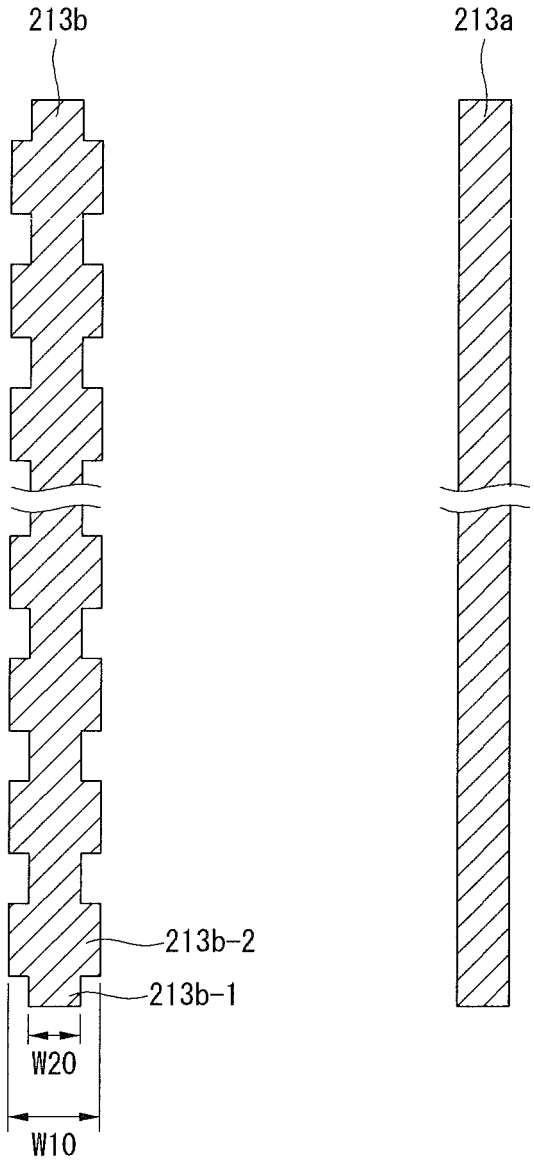

The address electrode positioned in the edge region of the panel may have a predetermined pattern, so that the width of the address electrode positioned in the edge region of the panel is greater than the width of the address electrode positioned in the middle region of the panel. For example, as shown in FIG. 29, the second address electrode 213*b* positioned in the edge region of the panel may include a portion 213*b*-2 having a width greater than the width of the first address electrode 213*a* positioned in the middle region of the panel. In other words, the second address electrode 213*b* positioned in the edge region of the panel may include a first portion 213*b*-1 and a second portion 213*b*-2. A width W10 of the second portion 213*b*-2 may be greater than a width W20 of the first portion 213*b*-1, and the width W10 of the second portion 213*b*-2 may be greater than the width of the first address electrode 213*a* positioned in the middle region of the panel.

Figure 30:
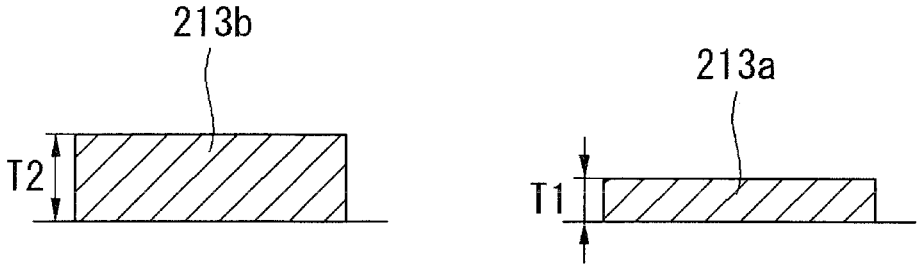

Alternatively, as shown in FIG. 30, a thickness T2 of the second address electrode 213*b* positioned in the edge region of the panel may be greater than a thickness T1 of the first address electrode 213*a* positioned in the middle region of the panel.

As above, even when the thickness or the width of the address electrode 213 is adjusted depending on the location of the panel, the same effect may be obtained. As shown in FIG. 30, an increase in the thickness of the address electrode 213 positioned in the edge region of the panel may correspond to an increase in the width of the address electrode 213 positioned in the edge region of the panel. Hereinafter, the increase in the width of the address electrode 213 positioned in the edge region of the panel is mainly described for the sake of brevity.

Figure 31:
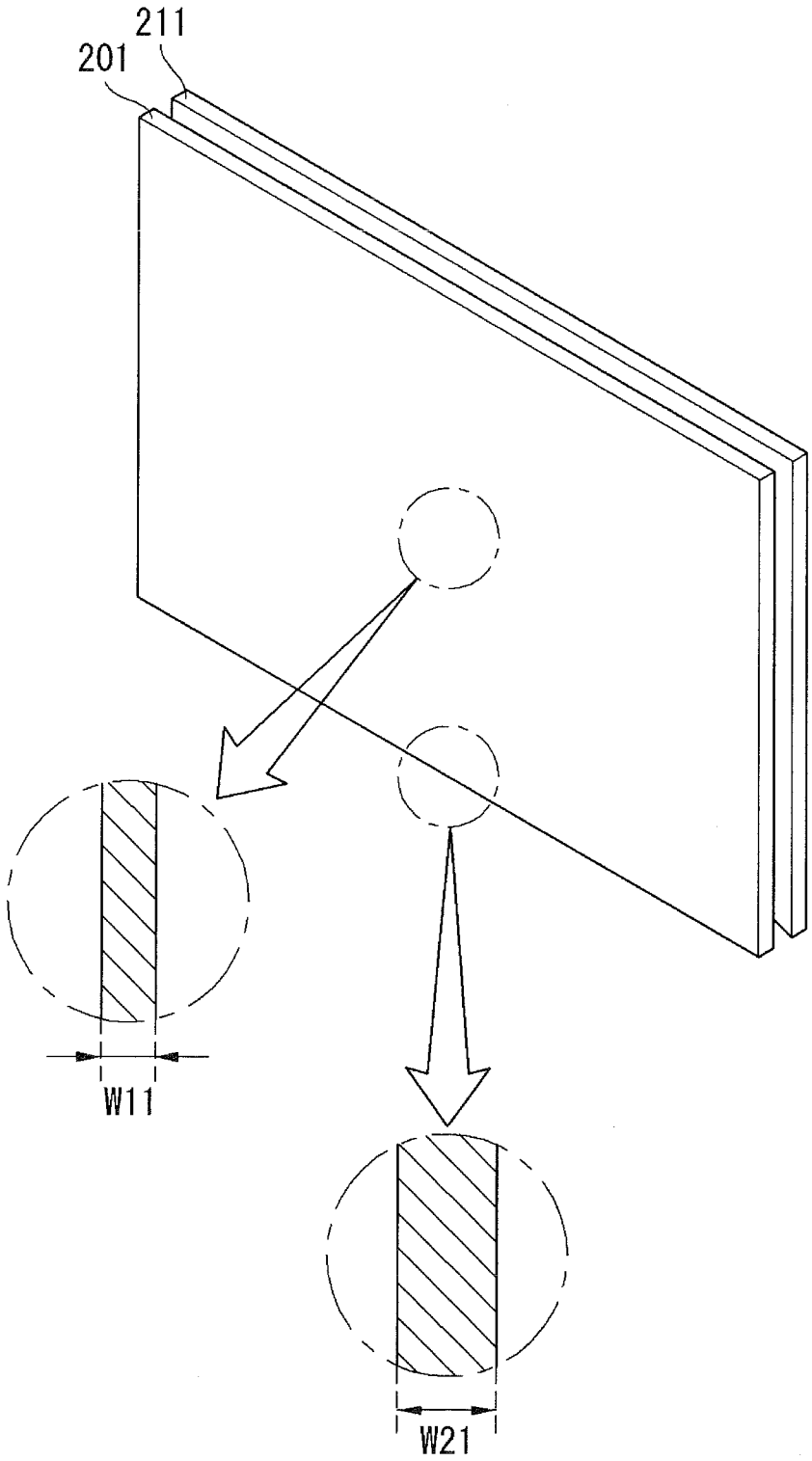
Figure 32:
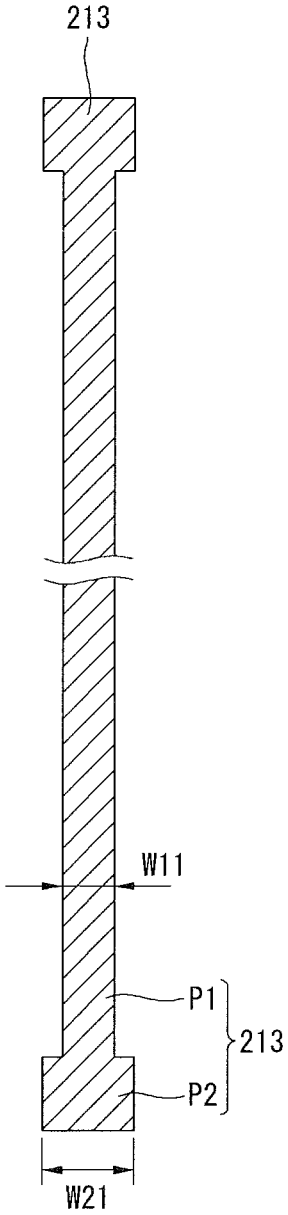

As shown in FIG. 31, the width of the address electrode 213 positioned in the edge region of the panel may be greater than the width of the address electrode 213 positioned in the middle region of the panel in the vertical direction of the panel, i.e., in the direction parallel to the address electrode 213. For example, as shown in FIG. 32, at least one of the plurality of address electrodes 213 may include a first portion P1 and a second portion P2, that has a width greater than a width of the first portion P1 and is positioned outside the first portion P1. The second portion P2 may be positioned in an area overlapping the outermost discharge cell in the vertical direction of the panel. Alternatively, the second portion P2 may overlap the plurality of discharge cells positioned in the edge region in the vertical direction of the panel.

As above, the discharge operation of the discharge cells positioned in the edge region of the panel may be stabilized by adjusting the width of the address electrode 213 in the vertical direction of the panel.

Figure 33:
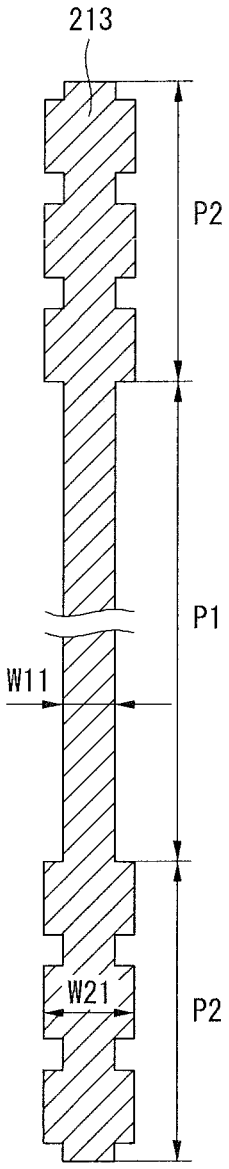

Further, the second portion P2 may have a predetermined pattern, so that the width of the second portion P2 of the address electrode 213 positioned in the edge region of the panel in the vertical direction of the panel is greater than the width of the first portion P1 of the address electrode 213. For example, as shown in FIG. 33, the second portion P2 of the address electrode 213 positioned in the edge region of the panel in the vertical direction of the panel may include a portion having a width W21 greater than a width W11 of the first portion P1 of the address electrode 213 positioned in the middle region of the panel.

In other words, the address electrode 213 may have the predetermined pattern in the edge region of the panel and may have a stripe pattern in the middle region of the panel in the vertical direction of the panel.

Figure 34:
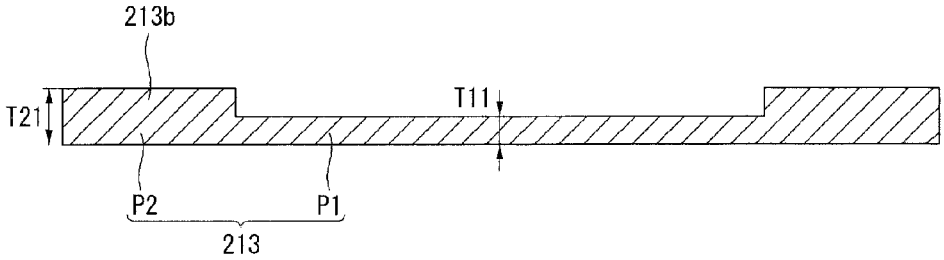

Alternatively, as shown in FIG. 34, the address electrode 213 may include a first portion P1 having a first thickness T11 in the vertical direction of the panel and a second portion P2 that has a second thickness T21 greater than the first thickness T11 and is positioned outside the first portion P1. Since this may correspond to the structure for adjusting the width of the address electrode 213 in the vertical direction of the panel, a further description may be briefly made of may be entirely omitted.

Figure 35:
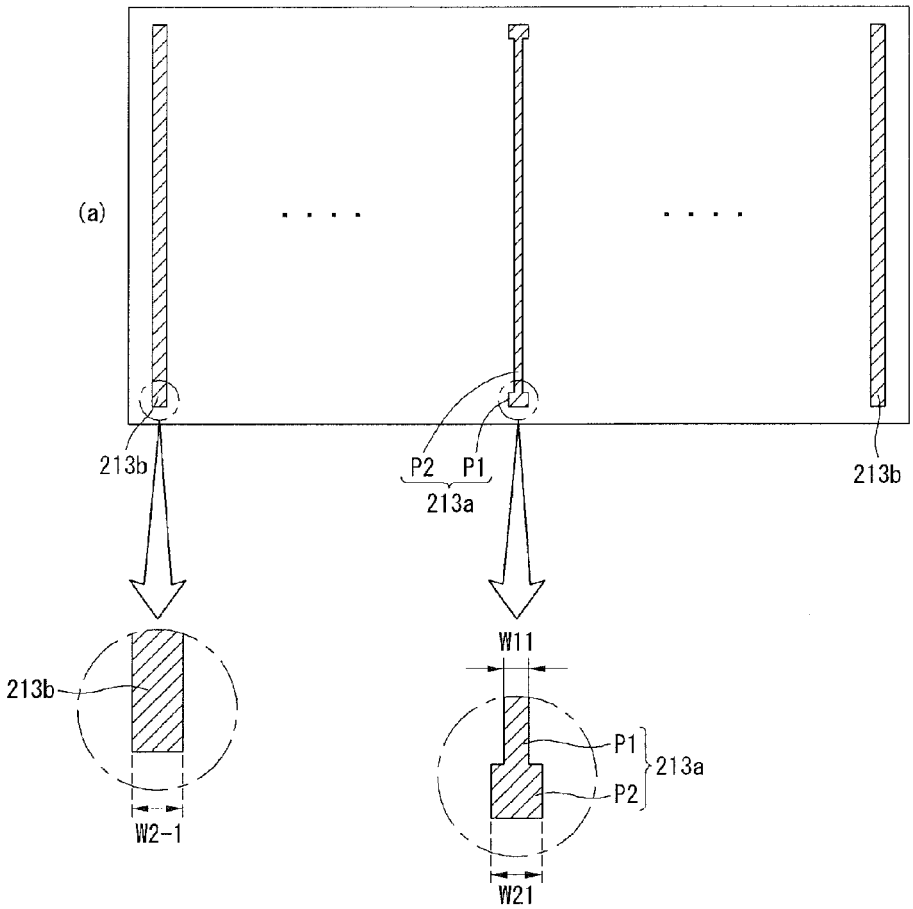
Figure 36:
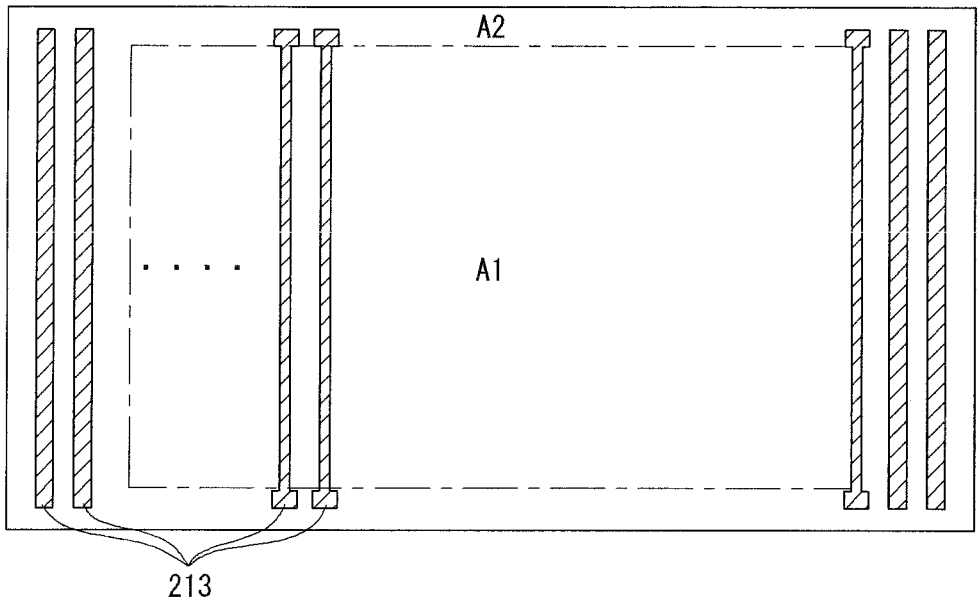

Alternatively, as shown in FIGS. 35 and 36, the width of the address electrode may be adjusted in the vertical direction of the panel (i.e., in the direction parallel to the address electrode) and in the horizontal direction of the panel (i.e., in the direction crossing the address electrode). Preferably, the width of the address electrode 213 positioned in the edge region of the panel may be greater than the width of the address electrode 213 positioned in the middle region of the panel in the direction parallel to the address electrode 213. Further, the width of the address electrode 213 positioned in the edge region of the panel may be greater than the width of the address electrode 213 positioned in the middle region of the panel in the direction crossing the address electrode 213.

More specifically, as shown in FIG. 35, the second address electrode 213*b* may be positioned in the edge region of the panel in the horizontal direction of the panel, and the first address electrode 213*a* may be positioned in the middle region of the panel in the horizontal direction of the panel In this instance, the first address electrode 213*a* may include a first portion P1 and a second portion P2 positioned outside the first portion P1. A width W21 of the second portion P2 may be greater than a width W11 of the first portion P1.

Further, the width W2-1 of the second address electrode 213*b* may be greater than the width W11 of the first portion P1 of the first address electrode 213*a* and may be substantially equal to the width W21 of the second portion P2 of the first address electrode 213*a*. Hence, the discharge operation of the discharge cells positioned in the edge region of the panel in the vertical direction and the horizontal direction of the panel may be stabilized.

Alternatively, as shown in FIG. 36, the width of the address electrode 213 in the middle region A1 of the panel may be less than the width of the address electrode 213 in the edge region A2 of the panel. The outermost discharge cell may be positioned in the edge region A2 of the panel.

FIGS. 37 to 41 illustrate another exemplary configuration of a multi plasma display panel according to an exemplary embodiment of the invention. Structures and components identical or equivalent to those illustrated in FIGS. 1 to 36 are designated with the same reference numerals, and a further description may be briefly made or may be entirely omitted.

Figure 37:
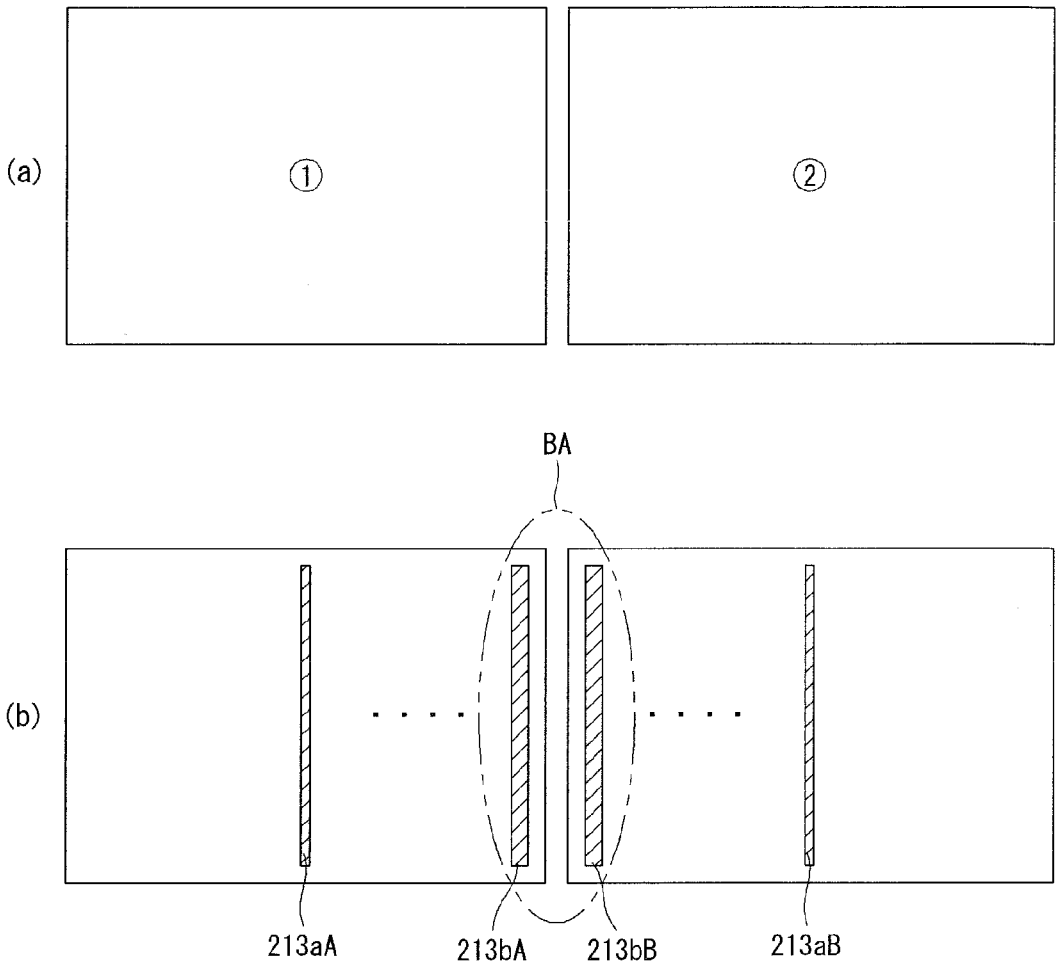
FIGS. 37 to 41 illustrate another exemplary configuration of a multi plasma display panel according to an exemplary embodiment of the invention.

As shown in FIG. 37, a width of an address electrode positioned in a boundary region BA between two panels ① and ② of the multi plasma display panel, that are positioned adjacent to each other in a horizontal direction, i.e., in a direction crossing the address electrode, may be greater than a width of the address electrode positioned in a middle region of each of the two adjacent panels ① and ②. In other words, a width of an address electrode 213*a*A in a first region of the first panel ① may be less than a width of an address electrode 213*b*A in a second region of the first panel ① that is closer to the second panel ② than the first region. Further, a width of an address electrode 213*a*B in a third region of the second panel ② may be less than a width of an address electrode 213*b*B in a fourth region of the second panel ② that is closer to the first panel ① than the third region.

An outermost discharge cell of the first panel ① may be positioned in the second region of the first panel ①, and an outermost discharge cell of the second panel ② may be positioned in the fourth region of the second panel ②.

A seam portion between the two adjacent panels ① and ② of the multi plasma display panel may reduce the image quality of the multi plasma display panel. Hence, the size of an edge region of the outermost discharge cell in the boundary region BA between the two adjacent panels ① and ② may decrease so as to reduce a width of the seam portion. However, when the size of the edge region of the outermost discharge cell in the boundary region BA decrease, an impurity gas may remain in the boundary region BA. Hence, the discharge cells positioned in the boundary region BA may perform the unstable discharge operation and may be turned off. As a result, the images may be discontinuously displayed on the two adjacent panels ① and ②, and the image quality of the multi plasma display panel may worsen.

On the other hand, as shown in FIG. 37, when the widths of the address electrodes 213*b*A and 213*b*B positioned in the boundary region BA between the two adjacent panels and are greater than the widths of the address electrodes 213*a*A and 213*a*B positioned in the middle regions of the panels ① and ②, the discharge operation in the boundary region BA may be stabilized. Hence, the image may be smoothly displayed on the two adjacent panels ① and ②. As a result, the image quality of the multi plasma display panel may be improved.

Accordingly, the plasma display panel illustrated in FIGS. 26 to 36 may be applied to the above-described multi plasma display panel.

Figure 38:
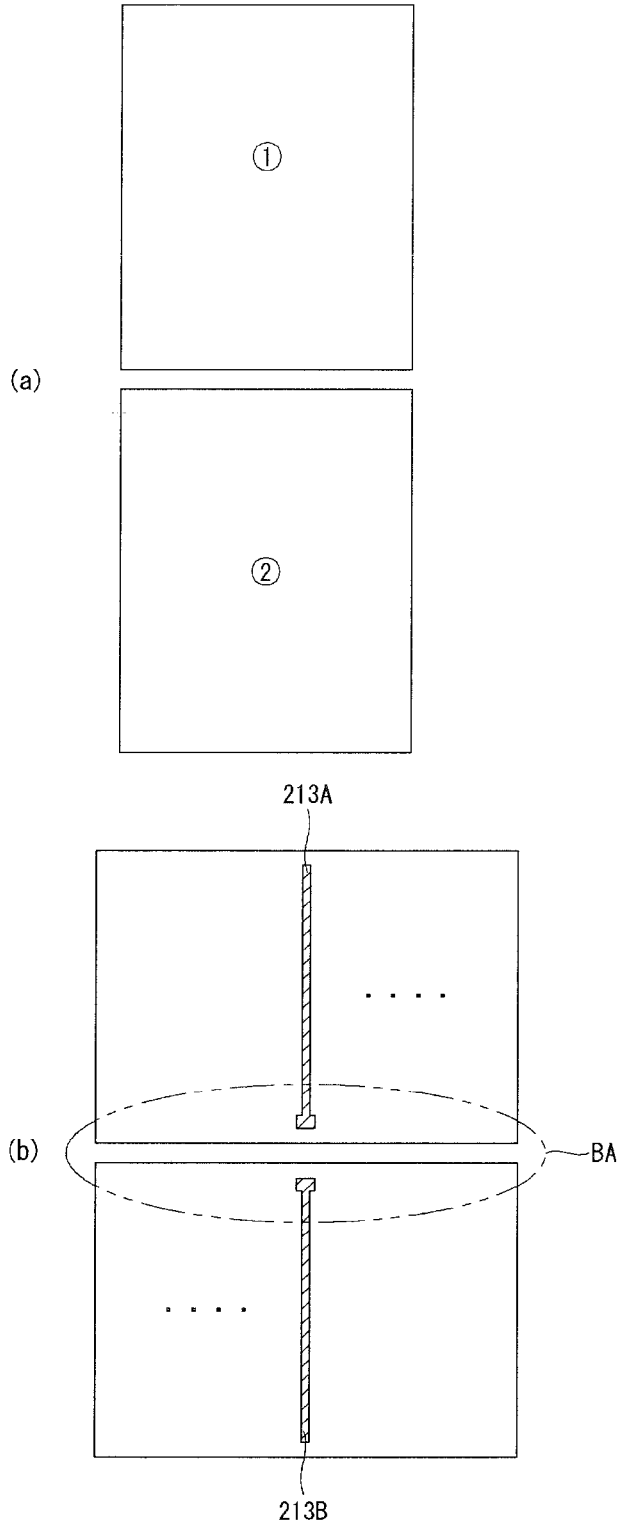

As shown in FIG. 38, widths of address electrodes 213A and 213B positioned in a boundary region BA between two panels ① and ② of the multi plasma display panel, that are positioned adjacent to each other in a vertical direction, i.e., in a direction parallel to the address electrode, may be greater than the widths of the address electrodes 213A and 213B positioned in middle regions of the panels ① and ②. Hence, the image quality of the multi plasma display panel may be improved.

Alternatively, the widths of the address electrodes positioned in a boundary region between two panels of the multi plasma display panel, that are positioned adjacent to each other in both the vertical and horizontal directions, may be greater than the widths of the address electrodes positioned in middle regions of the two panels.

Figure 39:
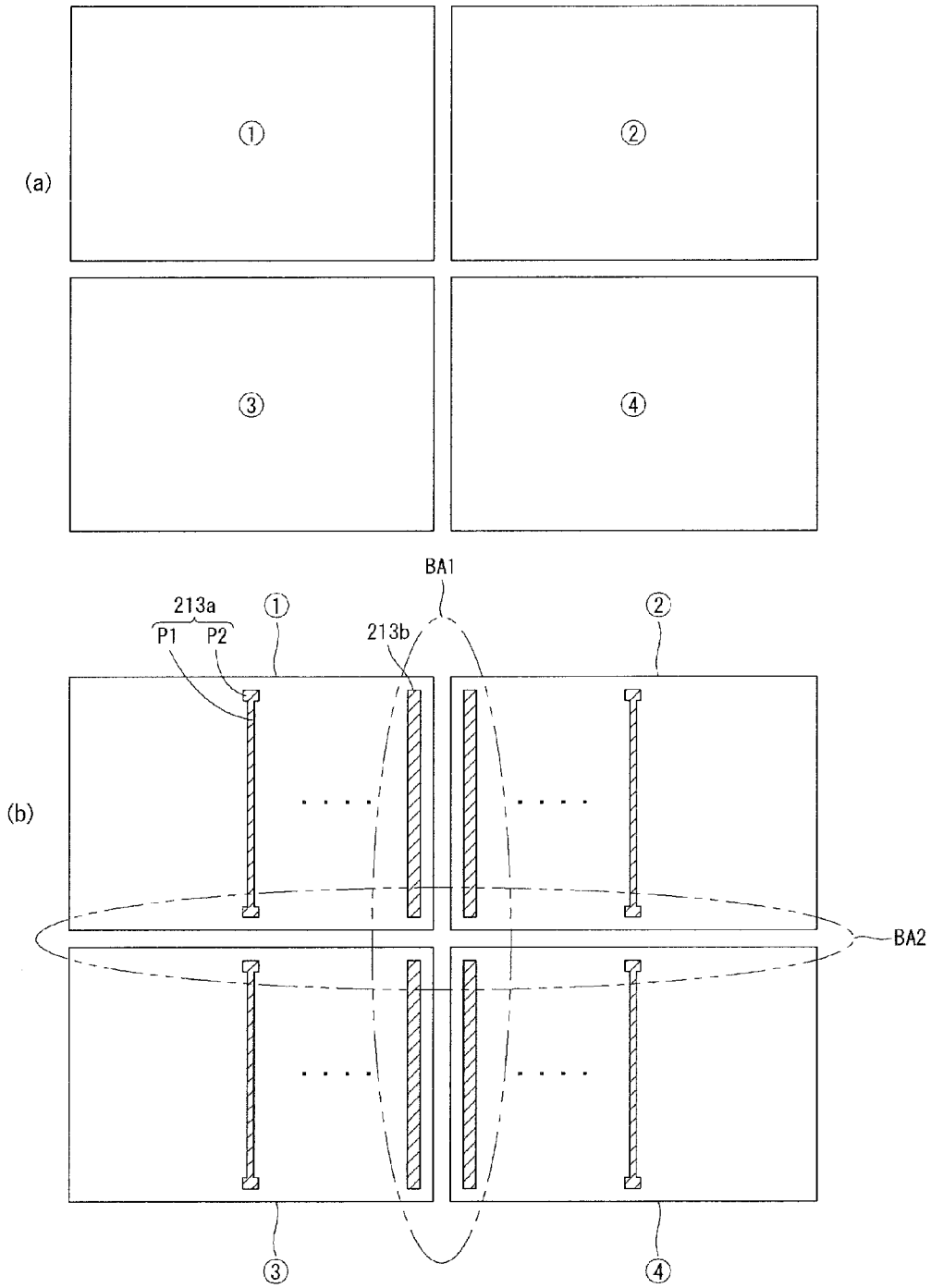

For example, as shown in FIG. 39(*a*), the multi plasma display panel may include a first panel ①, a second panel ② positioned adjacent to the first panel ①, a third panel ③ positioned adjacent to the first panel ①, and a fourth panel ④ positioned adjacent to the second panel ② and the third panel ③.

As shown in FIG. 39(*b*), a first address electrode 213*a* of the plurality of address electrodes of the first panel ① may include a first portion P1 and a second portion P2 that has a width greater than a width of the first portion P1 and is closer to the third panel ③ than the first portion P1.

Further, a second address electrode 213*b* of the plurality of address electrodes of the first panel ① is positioned closer to the second panel ② than the first address electrode 213*a*. A minimum width of the second address electrode 213*b* may be greater than a width of the first portion P1 of the first address electrode 213*a*. The second address electrode 213*b* may be disposed in an area overlapping an outermost discharge cell facing the second panel ② among a plurality of discharge cells of the first panel ①. Further, the second portion P2 of the first address electrode 213*a* may be disposed in an area overlapping an outermost discharge cell facing the third panel ③ among the plurality of discharge cells of the first panel ①.

The above-described configurations applied to the first panel ① may be applied to the second, third, and fourth panels ②, ③, and ④. Further, although it is not shown, a thickness of the address electrode may be adjusted instead of the adjustment of the width of the address electrode illustrated in FIGS. 37 to 39.

For example, the multi plasma display panel may include a first panel and a second panel that are positioned adjacent to each other. A thickness of the address electrode in a first region of the first panel may be less than a thickness of the address electrode in a second region of the first panel that is closer to the second panel than the first region. A thickness of the address electrode in a third region of the second panel may be less than a thickness of the address electrode in a fourth region of the second panel that is closer to the first panel than the third region.

Although the technical configuration for adjusting the width of the address electrode and the technical configuration for adjusting the size of the discharge cell have been separately described, the two technical configurations may be combined with each other. For example, while the size of the discharge cell positioned in the edge region of the panel is greater than the size of the discharge cell positioned in the middle region of the panel, the width or the thickness of the address electrode positioned in the edge region of the panel may be greater than the width or the thickness of the address electrode positioned in the middle region of the panel.

Figure 40:
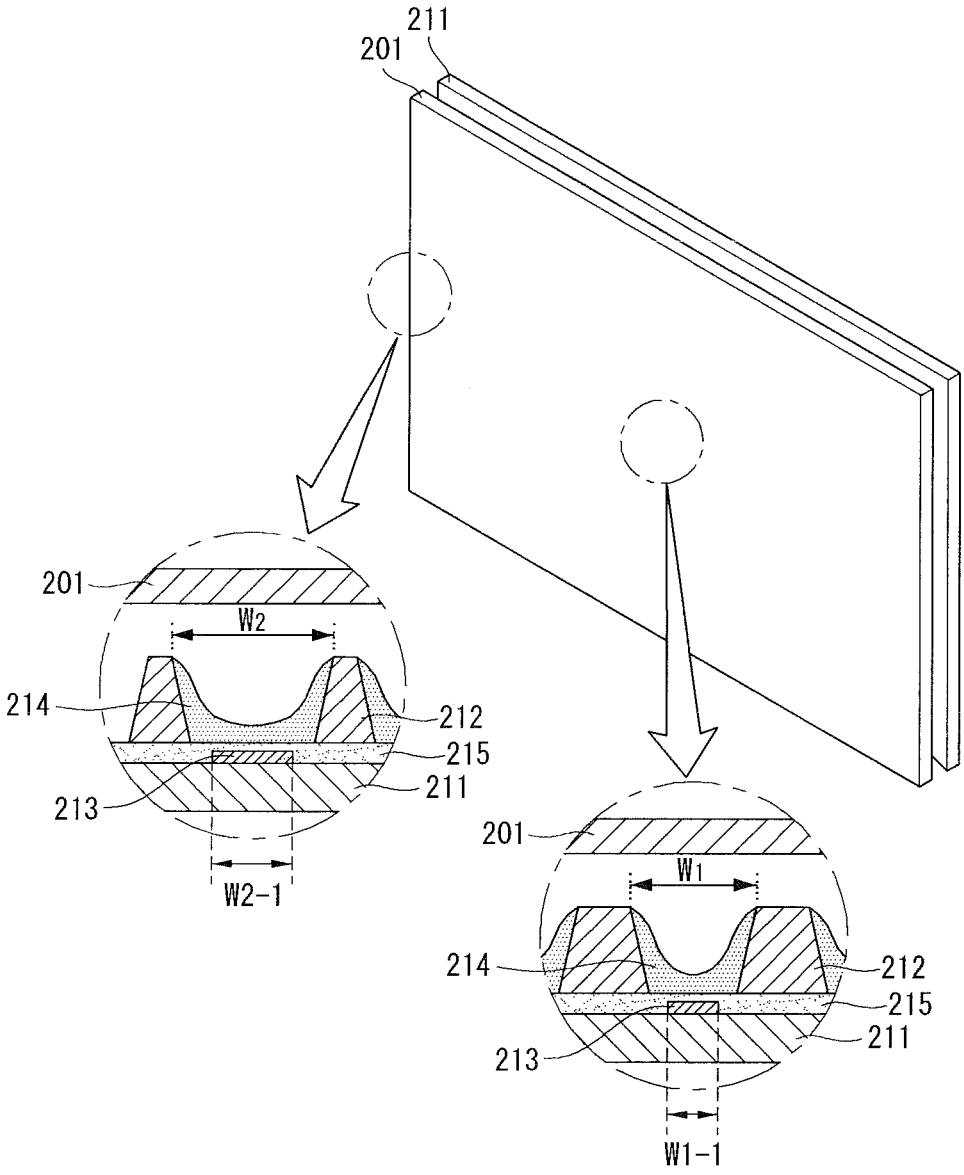

More specifically, as shown in FIG. 40, a width W1 of the discharge cell positioned in the middle region of the panel may be less than a width W2 of the discharge cell positioned in the edge region of the panel in the direction crossing the address electrode 213. In other words, the width W1 of the discharge cell positioned in the middle region of the panel may be less than the width W2 of the discharge cell positioned in the edge region of the panel in the horizontal direction. Preferably, a width of the outermost discharge cell of the panel may be greater than the width W1 of the discharge cell positioned in the middle region of the panel in the direction crossing the address electrode 213.

Further, a width W1-1 of the address electrode 213 corresponding to the discharge cell positioned in the middle region of the panel may be less than a width W2-1 of the address electrode 213 corresponding to the discharge cell positioned in the edge region of the panel. In other words, the width W1-1 of the address electrode 213 corresponding to the discharge cell positioned in the middle region of the panel may be less than the width W2-1 of the address electrode 213 corresponding to the discharge cell positioned in the edge region of the panel in the direction crossing the address electrode 213.

Alternatively, the widths of the plurality of second address electrodes positioned in the edge region of the panel may be greater than the widths of the plurality of first address electrodes positioned in the middle region of the panel. This was described above with reference to FIG. 27.

Figure 41:
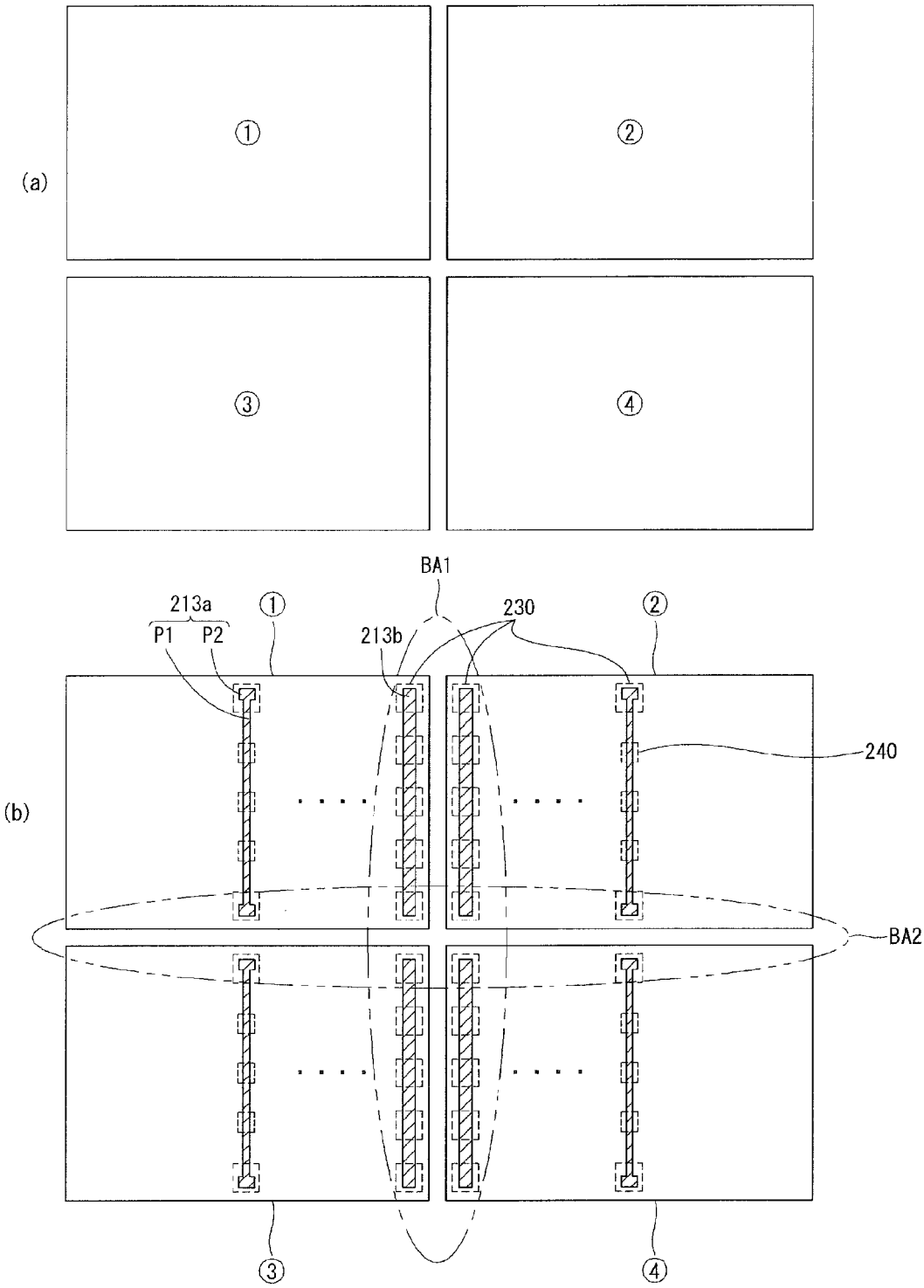

As shown in FIG. 41(*a*), the multi plasma display panel may include a first panel ①, a second panel ② positioned adjacent to the first panel ①, a third panel ③ positioned adjacent to the first panel ①, and a fourth panel ④ positioned adjacent to the second panel ② and the third panel ③.

As shown in FIG. 41(*b*), the size of the discharges cell 230 positioned in a boundary region BA1 between the first and second panels ① and ② may be greater than the size of the discharge cell 240 positioned in a middle region of each of the first and second panels ① and ②. Further, a width of an address electrode 213*b* positioned in the boundary region BA1 between the first and second panels ① and ② may be greater than a width of an address electrode 213*a* positioned in a middle region of each of the first and second panels ① and ②. The above configuration may be applied to a boundary region BA1 between the third and fourth panels ③ and ④.

Further, the size of the discharge cell 230 positioned in a boundary region BA2 between the first and third panels ① and ③ may be greater than the size of the discharge cell 240 positioned in the middle region of each of the first and third panels ① and ③. Further, the width of the address electrode 213*b* positioned in the boundary region BA2 between the first and third panels ① and ③ may be greater than the width of the address electrode 213*a* positioned in the middle region of each of the first and third panels ① and ③. Namely, the width of the address electrode 213*a* positioned in the boundary region BA2 between the first and third panels ① and ③ may increase. The above configuration may be applied to a boundary region BA2 between the second and fourth panels ② and ④.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A multi plasma display panel, comprising a plurality of plasma display panels that are positioned adjacent to one another, each of the plurality of plasma display panels including:

a front substrate on which a first electrode is disposed;

a back substrate which is positioned opposite the front substrate, the back substrate having a second electrode disposed thereon in a direction crossing the first electrode; and a plurality of barrier ribs positioned between the front substrate and the back substrate, the plurality of barrier ribs configured to define a plurality of discharge cells, wherein a size of the discharge cell in a boundary region of two plasma display panels of the plurality of plasma display panels is greater than a size of the discharge cell in the other regions of the two plasma display panels, and wherein a width of the barrier rib in the boundary region of the two plasma display panels of the plurality of plasma display panels is smaller than a width of the barrier rib in other regions.

2. A multi plasma display panel comprising:

a first plasma display panel; and a second plasma display panel positioned adjacent to the first plasma display panel, wherein each of the first and second plasma display panels includes:

a front substrate on which a first electrode is disposed;

a back substrate which is positioned opposite the front substrate, the back substrate having a second electrode disposed thereon in a direction crossing the first electrode; and a plurality of barrier ribs positioned between the front substrate and the back substrate, the plurality of barrier ribs configured to define a plurality of discharge cells, wherein a size of the discharge cell in a first region of the first plasma display panel is less than a size of the discharge cell in a second region of the first plasma display panel, the second region being closer to the second plasma display panel than the first region, wherein a width of the barrier rib in the first region of the first plasma display panels is greater than a width of the barrier rib in the second region of the first plasma display panel, wherein a width of the second electrode in the first region of the first plasma display panel is less than a width of the second electrode in the second region of the first plasma display panel, wherein a size of the discharge cell in a third region of the second plasma display panel is less than a size of the discharge cell in a fourth region of the second plasma display panel, the fourth region being closer to the first plasma display panel than the third region, wherein a width of the barrier rib in the third region of the second plasma display panels is greater than a width of the barrier rib in the fourth region of the second plasma display panel, and wherein a width of the second electrode in the third region of the second plasma display panel is less than a width of the second electrode in the fourth region of the second plasma display panel.

3. The multi plasma display panel of claim 2, wherein an outermost discharge cell of the first plasma display panel is disposed in the second region, and wherein an outermost discharge cell of the second plasma display panel is disposed in the fourth region.

4. A multi plasma display panel comprising:

a first plasma display panel;

a second plasma display panel positioned adjacent to the first plasma display panel;

a third plasma display panel positioned adjacent to the first plasma display panel; and a fourth plasma display panel positioned adjacent to the second and third plasma display panels, wherein each of the first, second, third, and fourth plasma display panels includes:

a front substrate on which a first electrode is disposed;

a back substrate which is positioned opposite the front substrate, the back substrate having a second electrode disposed thereon in a direction crossing the first electrode; and a plurality of barrier ribs positioned between the front substrate and the back substrate, the plurality of barrier ribs configured to define a plurality of discharge cells, wherein a size of the discharge cell in a first region of the first plasma display panel is less than a size of the discharge cell in a second region of the first plasma display panel, the second region being closer to the second plasma display panel than the first region in a direction parallel to the first electrode, and a size of the discharge cell in a third region of the first plasma display panel, the third region being closer to the third plasma display panel than the first region in a direction parallel to the second electrode, wherein a width of the discharge cell measured in the direction parallel to the first electrode in the second region is greater than a width of the discharge cell measured in the direction parallel to the first electrode in the first region, wherein a width of the discharge cell measured in the direction parallel to the second electrode in the third region is greater than a width of the discharge cell measured in the direction parallel to the second electrode in the first region, wherein in the direction parallel to the first electrode, a width of the barrier ribs in the first region of the first plasma display panel is greater than a width of the barrier ribs in the second region of the first plasma display panel, and wherein in the direction parallel to the second electrode, a width of the barrier rib in the first region of the first plasma display panel is greater than a width of the barrier rib in the third region of the first plasma display panel.

5. The multi plasma display panel of claim 4, wherein an outermost discharge cell is disposed in each of the second and third regions.

6. The multi plasma display panel of claim 4, wherein a width of the discharge cell measured in the direction parallel to the first electrode in the third region is greater than a width of the discharge cell measured in the direction parallel to the first electrode in the first region.

7. The multi plasma display panel of claim 1, wherein a width of the second electrode in the boundary region of the two plasma display panels of the plurality of plasma display panels is greater than a width of the second electrode in the other regions.

8. The multi plasma display panel of claim 7, wherein the second electrode in the boundary region of the two plasma panels has a uniform width, and the second electrodes in the other regions of the two plasma display panels have non-uniform width where end portions have a greater width than a portion between the end portions.

* * * * *